US007529500B2

(12) United States Patent
Eguchi

(10) Patent No.: US 7,529,500 B2
(45) Date of Patent: May 5, 2009

(54) IMAGE FORMING APPARATUS AND MOUNTING MEMBER FOR THE IMAGE FORMING APPARATUS

(75) Inventor: Naomi Eguchi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 137 days.

(21) Appl. No.: 11/225,998

(22) Filed: Sep. 14, 2005

(65) Prior Publication Data

US 2006/0067731 A1 Mar. 30, 2006

(30) Foreign Application Priority Data

Sep. 24, 2004 (JP) ..... 2004-276809

(51) Int. Cl.
*G03G 15/00* (2006.01)

(52) U.S. Cl. ..... 399/107; 399/110; 399/90

(58) Field of Classification Search ..... 399/107, 399/110, 377, 90; 248/409
See application file for complete search history.

(56) References Cited

U.S. PATENT DOCUMENTS

| | | | | |
|---|---|---|---|---|
| 208,823 | A * | 10/1878 | Jennings | 248/409 |
| 3,770,334 | A * | 11/1973 | Weber | |
| 5,493,368 | A * | 2/1996 | Nishio | |
| 2005/0031371 | A1* | 2/2005 | Kaida et al. | 399/110 |
| 2005/0152715 | A1* | 7/2005 | Park et al. | 399/110 |

FOREIGN PATENT DOCUMENTS

| | | | |
|---|---|---|---|
| JP | 59033465 | A * | 2/1984 |
| JP | 04311969 | A * | 11/1992 |
| JP | 05207210 | A * | 8/1993 |
| JP | 06124009 | A * | 5/1994 |
| JP | 2001160883 | A * | 6/2001 |
| JP | 2004-045906 | A | 2/2004 |
| JP | 2004045906 | A * | 2/2004 |
| JP | 2004146930 | A * | 5/2004 |

OTHER PUBLICATIONS

Machine Translation of Mae (JP 2004-045906 A).*

* cited by examiner

*Primary Examiner*—David M Gray
*Assistant Examiner*—Laura K Roth
(74) *Attorney, Agent, or Firm*—Panitch Schwarze Belisario & Nadel LLP

(57) ABSTRACT

An image forming apparatus having an image reading unit for reading optically an image on an original document and an image forming unit for forming the image on a recording medium based on image information read with the image reading section includes a mounting member composed of a first mounting member mounting the image forming unit thereon and a second mounting member mounting the image reading unit thereon, formed above the first mounting member and configured as upward and downward movable with respect to the first mounting member, a pushing section for pushing upward the second mounting member, and a level setting section for setting the second member at a prescribed level.

4 Claims, 23 Drawing Sheets

IMAGE FORMING APPARATUS AND MOUNTING MEMBER FOR THE IMAGE FORMING APPARATUS

BACKGROUND OF THE INVENTION

1. Field of the Invention

This invention relates to an image forming apparatus having an image reading unit for reading optically an image on an original document and an image forming unit for forming an image on a predetermined recording medium based on image information read with the image reading unit, and to a mounting member for the image forming apparatus for mounting thereon the image forming apparatus.

2. Description of Related Art

An image forming apparatus generally feeds a paper from a paper cassette for storing the paper defined as a recording medium through a feeding roller and conveys the paper to an image forming unit through a conveyance roller. Where forming the images on the paper using the image forming unit, the image forming apparatus conveys the paper to a fusing unit to fuse the images, thereby delivering the paper to an exterior of the apparatus.

With the image forming apparatus of this type, in the event of a trouble that the delivered paper is jammed while fed to be delivered to the exterior, a top cover forming one part of an exterior appearance is made open to remove the jammed paper. Furthermore, the top cover of the image forming apparatus is made open to be subject to maintenance operation.

Conventionally, an image forming apparatus for realizing a photocopying function has also been proposed upon combination of a function of forming the images on the recording medium and a function of reading optically the images on an original document. This image forming apparatus such as described in, e.g., Japanese Patent Application Publication No. 2004-45,906, is formed with units divided into a unit for forming the images and a unit for reading the image on the original document.

More specifically, the above mentioned Japanese Patent Application Publication No. 2004-45,906 discloses the image forming apparatus having an original document reading unit for reading image information on the original document stacked on an original document tray and an image forming unit for forming the images on a transferred member based on the image information read with the original document reading unit. Particularly in this image forming apparatus, the image reading unit is disposed above the image forming unit whereas a part or all parts above the image forming unit are movable in an openable manner. In a case of making a maintenance operation to this image forming apparatus, a mounting member mounting the original document reading unit is pivotally rotated at ninety degrees to open a part or all parts above the image forming apparatus, thereby opening a top cover to make the above operation.

The image forming apparatus described in the above mentioned Japanese Patent Application Publication No. 2004-45,906, however, raises a problem that a location at which the image forming apparatus is installed is limited while an area of the installation location cannot be reduced because the above location needs to have an extra space for at least a floor area of the mounting member to allow the mounting member pivotally movable at ninety degrees to be pivotally movable without contact with peripheral obstacles.

This invention has been invented in consideration of the above background, and it is an object of the invention to provide an image forming apparatus capable of improving installation location's flexibility and reducing the area needed for the installation location and to provide a mounting member for an image forming apparatus mounting thereon the image forming apparatus.

SUMMARY OF THE INVENTION

To achieve the above described objects, an image forming apparatus having an image reading unit for reading optically an image on an original document and an image forming unit for forming the image on a recording medium based on image information read with the image reading unit comprises a mounting member including a first mounting member mounting the image forming unit thereto and a second mounting member mounting the image reading unit thereto, the second mounting member being formed above the first mounting member and being movable up and down with respect to the first mounting member, a pushing section for pushing upward the second mounting member, and a level setting section for setting the second member at a prescribed level.

On the image forming apparatus according to the invention, the second mounting member for staking the image reading unit thereon is formed above the first mounting member for mounting the image forming unit thereon and is configured as upward and downward movable. That is, on the image forming apparatus according to this invention, the second mounting member is moved upward and downward depending on a status of using the image forming unit, thereby rendering a distance between the second and first mounting members variable.

The image forming apparatus according to this invention has a releasing section for releasing level set with the level setting section. That is, the image forming apparatus according to this invention is configured to release in using the releasing section a set level of the second mounting member set at a predetermined level with the level setting section.

Herein, the level setting section is configured to set the image forming unit at least at a level at which the image forming unit is ordinary used. The pushing section is set to have pushing force enough to move upward the second mounting member in a case where the releasing section releases the level set with the level setting section. Furthermore, the level setting section may be configured to set the image forming unit at either a first level in ordinary use or a second level higher than the first level selectively. In this case, the pushing section is set to have the pushing force enough to move upward the second mounting member where the releasing section releases the level set of the image forming unit at the first level with the level setting section as well as move downward the second mounting member where the releasing section releases the level set of the image forming unit at the second level with the level setting section The image forming apparatus according to this invention comprises a pair of connectors for connecting electrically the image reading unit to the image forming unit. The pair of connectors is configured to be disengaged from each other in accordance with upward movement of the second mounting member and to be engaged into each other in accordance with downward movement of the second mounting member. As described above, with the image forming apparatus according to this invention, a cable does not need a surplus length required for movement of the second mounting member since the connectors are disengaged where the second mounting member is moved upward.

The image forming apparatus according to this invention has a section for moving upward the second mounting member in association with opening of a cover for opening and closing an upper surface of the image forming unit. Thus, on the image forming apparatus according to this invention, the second mounting member can be moved upward only upon operation for opening the cover of the image forming unit, thereby being able to reduce the operation forced on a user at a time of the maintenance operation or the like.

The image forming apparatus according to this invention has a section for closing in association with downward movement of the second mounting member the cover for opening and closing the upper surface of the image forming unit in an open status. Thus, on the image forming apparatus, operation for opening and closing the cover can be reduced at a time of the maintenance operation or the like since the cover of the image forming unit can be closed at the same time as operation for pushing downward the second mounting member is made.

Furthermore, according to this invention, an image forming apparatus mounting member for mounting thereon an image forming apparatus having an image reading unit for reading optically an image on an original document and an image forming unit for forming the image on a recording medium based on image information read with the image reading section comprises a first mounting table for mounting thereon the image forming unit, a second mounting table for mounting thereon the image reading unit, formed above the first mounting table, configured as upward and downward movable with respect to the first mounting table, a pushing section for pushing upward the second mounting table, and a level setting section for setting the second table at a prescribed level.

On the image forming apparatus mounting member according to this invention, the second mounting table for mounting the image reading unit thereon is formed above the first mounting table for mounting the image forming unit thereon and is configured as upward and downward movable, so that a distance between the second and first mounting tables can be variable upon moving the second mounting table upward and downward depending on a status of using the image forming unit.

The image forming apparatus mounting member according to this invention has a releasing section for releasing level set with the level setting section. That is, the image forming apparatus mounting member according to this invention is configured to release in using the releasing section a set level of the second mounting table set at a predetermined level with the level setting section.

Herein, the level setting section is configured to set the image forming unit at least at a level at which the image forming unit is ordinary used. The pushing section is set to have pushing force enough to move upward the second mounting table in a case where the releasing section releases the level set with the level setting section. Furthermore, the level setting section may be configured to set the image forming unit at either a first level in ordinary use or a second level higher than the first level selectively. In this case, the pushing section is set to have the pushing force enough to move upward the second mounting table where the releasing section releases the level set of the image forming unit at the first level with the level setting section as well as move downward the second mounting table where the releasing section releases the level set of the image forming unit at the second level with the level setting section The image forming apparatus mounting member according to this invention has a pair of connectors for connecting electrically the image reading unit to the image forming unit. The pair of connectors is configured to be disengaged from each other in accordance with upward movement of the second mounting table and to be engaged into each other in accordance with downward movement of the second mounting table. As described above, with the image forming apparatus according to this invention, a cable does not need a surplus length required for movement of the second mounting table since the connectors are disengaged where the second mounting table is moved upward.

The image forming apparatus mounting member according to this invention has a movable member for moving upward the second mounting table in association with opening of a cover for opening and closing an upper surface of the image forming unit. Thus, on the image forming apparatus according to this invention, the second mounting table can be moved upward only upon operation for opening the cover of the image forming unit, thereby being able to reduce the operation forced on a user at a time of the maintenance operation or the like.

The image forming apparatus mounting member according to this invention has a closing section for closing in association with downward movement of the second mounting table the cover for opening and closing the upper surface of the image forming unit in an open status. Thus, on the image forming apparatus, operation for opening and closing the cover can be reduced at a time of the maintenance operation or the like since the cover of the image forming unit can be closed at the same time as operation for pushing downward the second mounting table is made.

The image forming apparatus mounting member according to this invention can be installed even in a limited place because the second mounting table can be moved upward depending on a status of use of the image forming unit to render a distance between the second and first mounting tables variable. That is, according to this invention, flexibility of the installation location can be improved while an area of the installation location can be reduced.

BRIEF DESCRIPTION OF THE DRAWINGS

This invention may take physical form in certain parts and arrangements of parts, a preferred embodiment and method of which will be described in detail in this specification and illustrated in the accompanying drawings which form a part hereof, and wherein;

FIG. 9 is a side view of the mounting member of the image forming apparatus, showing a status of the mounting member at a time of maintenance or the like;

FIG. 16 is a side view of the mounting member of the image forming apparatus, showing a status of the mounting member in a time of maintenance or the like;

DETAILED DESCRIPTION OF PREFERRED EMBODIMENTS OF THE INVENTION

Hereinafter, specific embodiments to which this invention applies will be described in detail in reference with drawings.

This embodiment is about the image forming apparatus having a scanning apparatus serving as an image reading unit for reading optically images on an original document and a printing apparatus serving as an image forming unit for forming the images on a predetermined medium based on image information read with the scanning apparatus. Especially in this image forming apparatus, the printing apparatus and the scanning apparatus are to be installed in a manner to be mounted on predetermined mounting members respectively, and flexibility of an installation location can be improved whereas an area of the installation location can be reduced. It is to be noted that an apparatus composed of the printing apparatus, the scanning apparatus, and the mounting member is hereinafter referred to as the image forming apparatus.

An image forming apparatus according to the first embodiment of this invention is described first.

Figure 1:
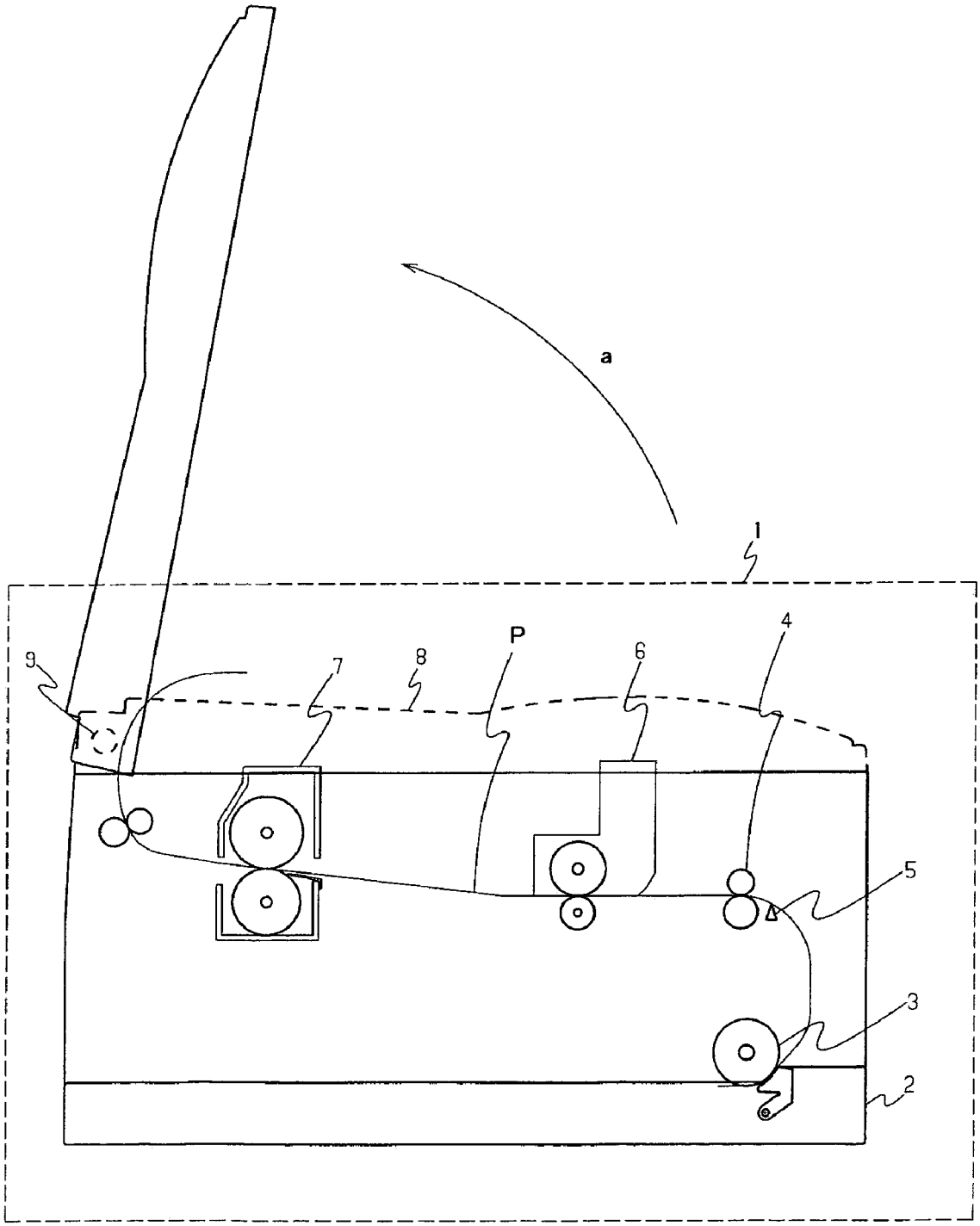
FIG. 1 is a cross-sectional view illustrating a structure of a printing apparatus of an image forming apparatus according to a first embodiment of this invention.

The image forming apparatus according to the first embodiment has a printing apparatus 1 serving as an image forming unit as shown in FIG. 1.

The printing apparatus 1 has a paper cassette 2 for storing a recording paper P defined as a recoding medium. The recording papers P stored in the paper cassette 2 are fed sheet by sheet from the paper cassette 2 upon rotation of a feeding roller 3, thereby being conveyed to an image forming unit 6 to be hereinafter described, in accordance with rotation of a conveyance roller 4 disposed at a paper conveyance route inside the printing apparatus 1. It is to be noted that the printing apparatus 1 has a paper detecting sensor 5 for detecting a status that a front end of the recording paper P in a conveyance direction is moved up to the vicinity of the conveyance roller 4, and a position of the recording paper P on the paper conveyance route can be recognized based on a detection signal from the paper detecting sensor 5.

Furthermore, the printing apparatus 1 has on a downstream side of the conveyance roller 4 an image forming unit 6 for forming the images on the recording paper P. The image forming unit 6 has image drums or transfer rollers for transferring toner images, not shown, corresponding to colors of, i.e., yellow (Y), magenta (M), cyan (C), and black (B), respectively. The image forming unit 6 forms electrostatic latent images on a photosensitive drum stored in the image drum and develops the electrostatic latent images with toner into toner images, thereby transferring the toner images on the photosensitive drum to the recording paper P.

The printing apparatus 1 has a fusing unit 7 for fusing to the recording paper P the toner images formed on the recording paper P with the image forming unit 6. The fusing unit 7 has, for example, a heater, a pressing roller, or the like, and fuses the toner images on the recording paper P with heat and pressure. With the printing apparatus 1, the recording paper P is conveyed and delivered to an exterior where fused with the images.

The printing apparatus 1 has a top cover 8 pivotally supported with a pivotal center 9. This top cover 8 covers an upper surface of the printing apparatus 1 in ordinary use and forms one part of an exterior appearance. This top cover 8 is made open upon rotated in a direction of arrow a shown in FIG. 1 around the center 9 as a center of rotation in a case of making operation such as, e.g., removal of such a recording paper P as jammed during conveyance operation, or maintenance operation, or the like. Therefore, in the printing apparatus 1, an interior part can be visually confirmed, so that the user can make the maintenance operation or the like.

The printing apparatus 1 is mounted on the predetermined mounting member to be installed into a predetermined installation location. The mounting member is divided broadly into a first mounting member for mounting thereon the printing apparatus 1 and a second mounting member for mounting thereon the scanning apparatus serving as an image reading unit for reading optically the images on the original document.

Figure 2:
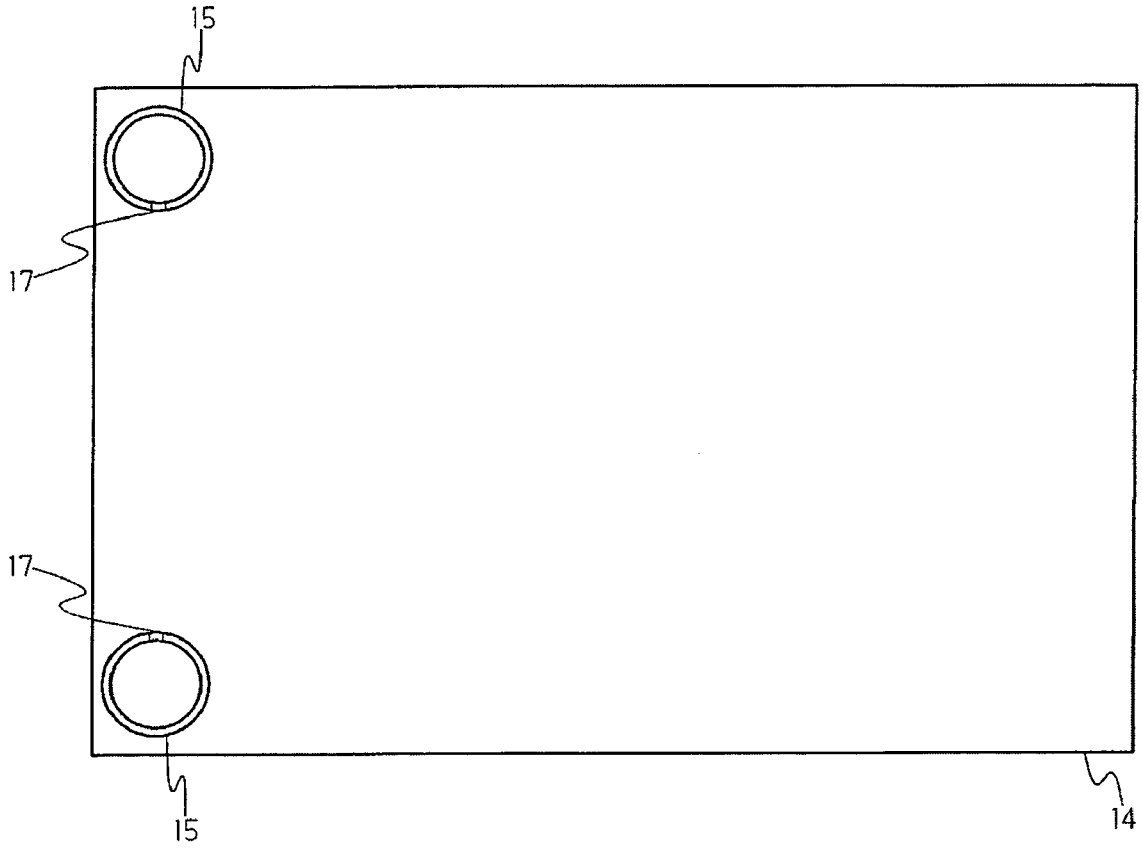
FIG. 2 is a plan view of a first mounting member composing a mounting member of the image forming apparatus.
Figure 3:
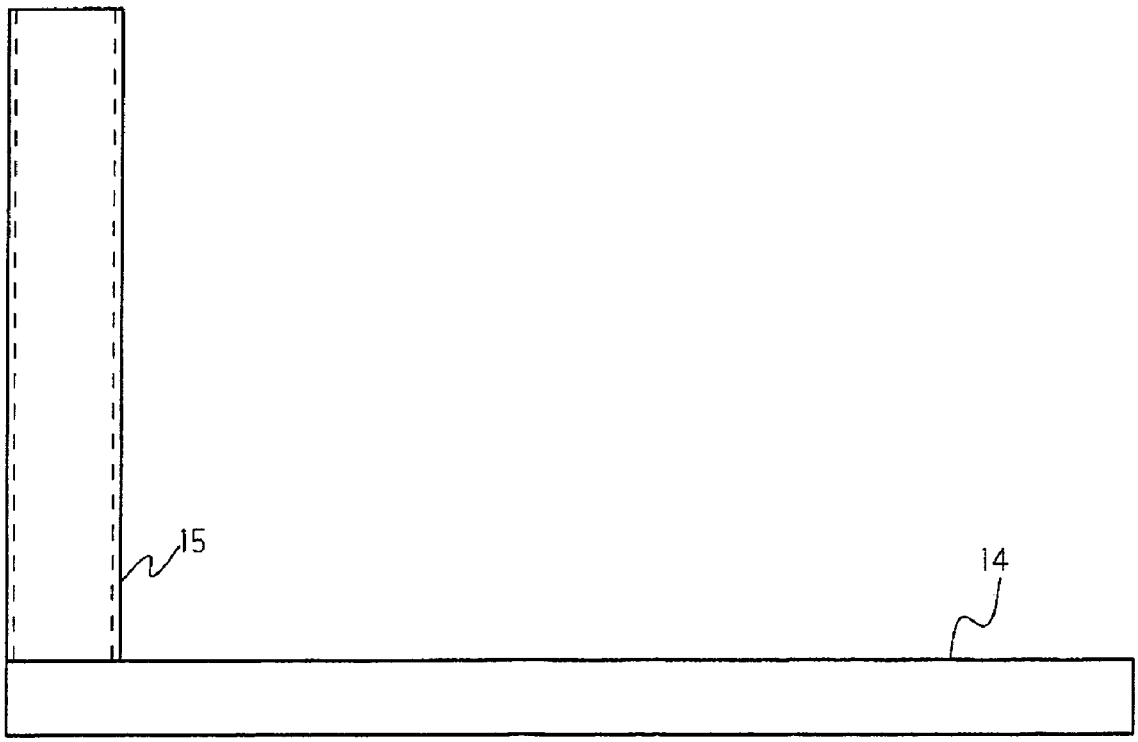
FIG. 3 is a side view of the first mounting member composing the mounting member of the image forming apparatus.
Figure 4:
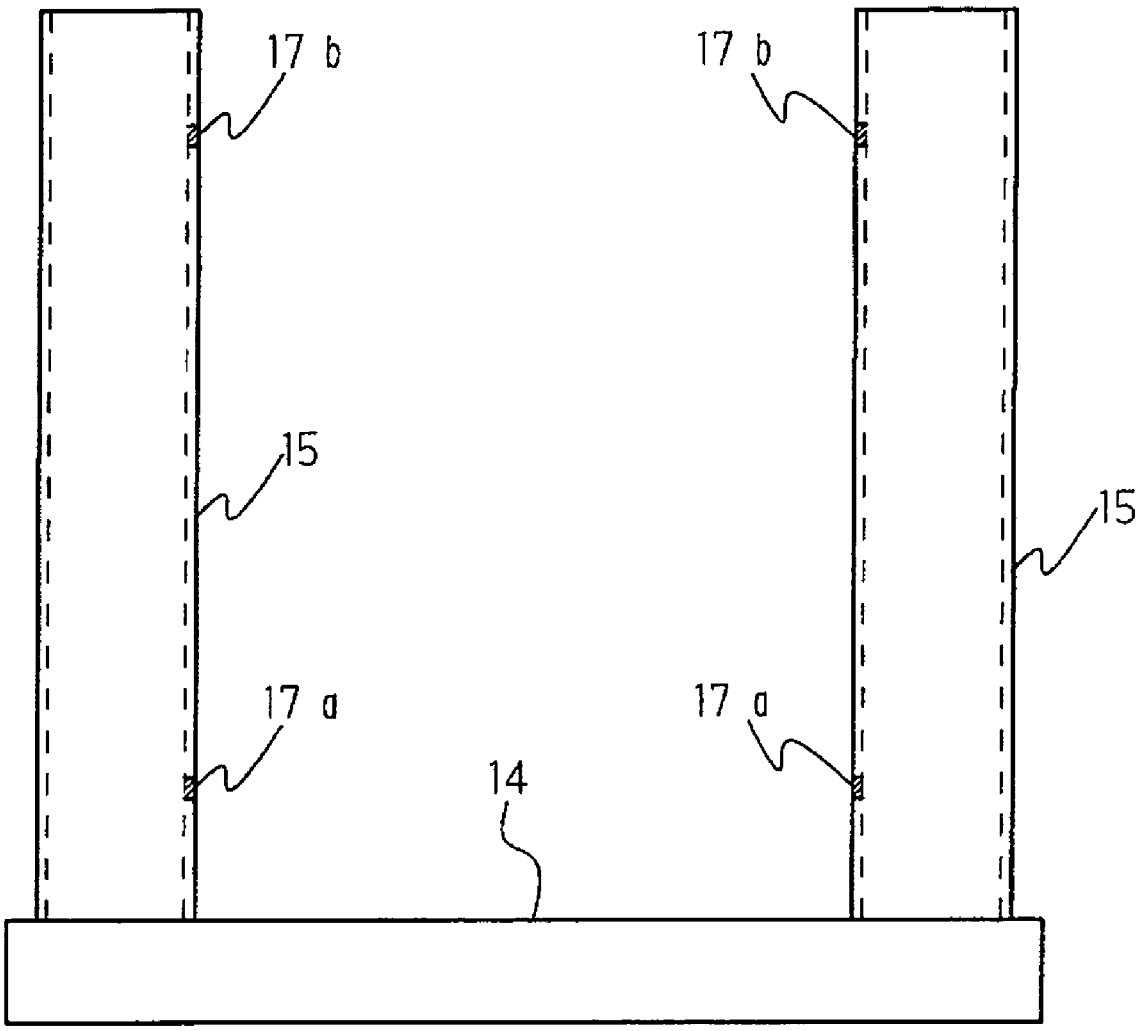
FIG. 4 is a rear view of the first mounting member composing the mounting member of the image forming apparatus.

The first mounting member has a foundation 14 in a flat plate shape serving as a first mounting table forming a surface mounting the printing apparatus 1 thereto, as shown in a plan view in FIG. 2 and a side view in FIG. 3. A prop 15 is formed upright in a perpendicularly upward direction to each of two corners forming opposite side ends of one margin of the foundation 14. Each of those props 15 has an opening 17 formed in a side surface. More specifically, openings 17*a*, 17*b* are respectively formed at two parts distance from each other in upward and downward directions in the side surface of the prop 15, as FIG. 4 shows a rear view of the first mounting member. An interval between the openings 17*a*, 17*b* is set to a perpendicular distance formed with the top cover 8 of the printing apparatus 1 brought in an open status from a closed status to make the maintenance operation sufficiently.

Figure 5:
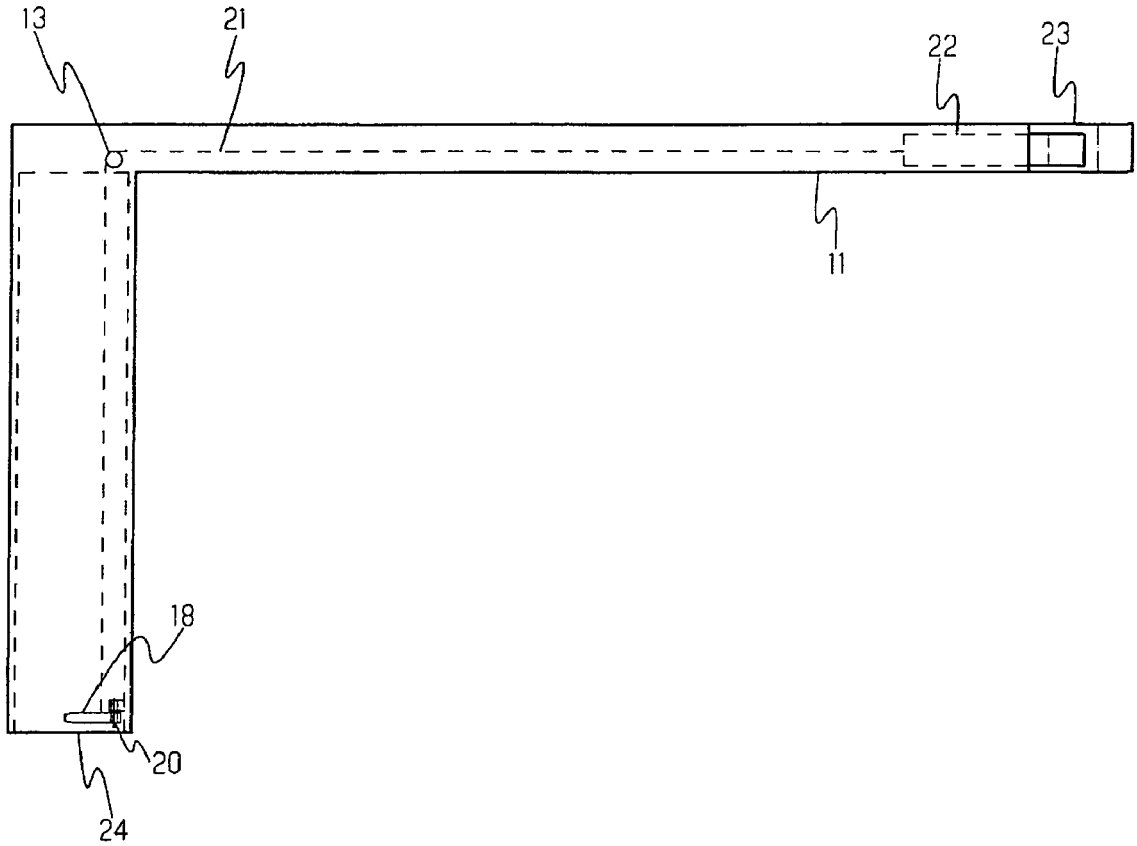
FIG. 5 is a side view of a second mounting member composing the mounting member of the image forming apparatus.
Figure 6:
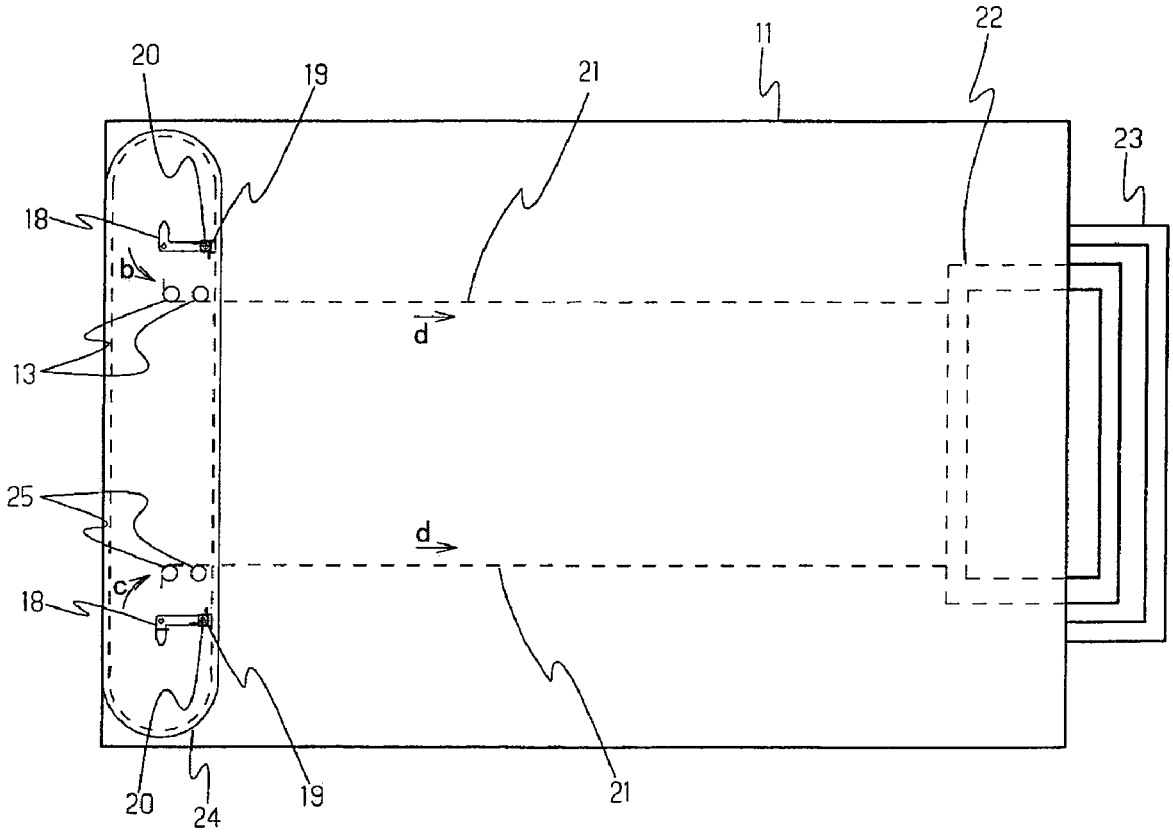
FIG. 6 is a plan view of a second mounting member composing the mounting member of the image forming apparatus.

On the other hand, the second mounting member has a mounting table 11 in a flat plate shape serving as a second mounting table forming a surface mounting the s scanning apparatus thereto, as shown in a side surface view in FIG. 5. A prop 24 having a cavity inside an interior portion thereof is formed upright in a perpendicularly downward direction in the mounting table 11 along with one margin of the mounting table 11 in a manner to be engaged with two props 15. Furthermore, in the second mounting member, two level setting levers 18 serving as a level setting section for setting the mounting table 11 at the predetermined level are formed as projecting through a spring member 19 at an interiors wall of the prop 24. Yet more specifically, those level setting levers 18 are formed at the vicinity of a lower end portion of both left and right opposite ends of the prop 24 and configured as rotatable in directions of arrows b, c around a center 20 as a center of rotation as FIG. 6 shows a plan view of the second mounting member.

Furthermore, the second mounting member is formed with a releasing section for releasing a level set with the level setting lever 18. More specifically, the second mounting member is arranged with a wire 21 having one end connected to the level setting lever 18. The wire 21 is arranged in a perpendicular direction along from the level setting lever 18 to the prop 24 and inserted via a supporting member 13 formed at the vicinity of a joint part between the mounting table 11 and the prop 24, into a cavity formed inside the interior portion of the mounting table 11, thereby being arranged in a horizontal direction along the mounting table 11. The other end of the wire 21 is connected as integrally movable to a handle 22 formed as fastened to a margin opposite to the prop 24 on the mounting table 11. This wire 21 is pulled through the handle 22 in a direction of arrow d, thereby being operated in a manner to rotate the level setting lever 18 connected to one end of the wire 21 in directions of arrows b, c shown in FIG. 6.

Furthermore, a handle 23 for rendering the entire second mounting member portable is disposed as fastened to a margin opposing to the prop 24 at the mounting table 11.

Figure 7:
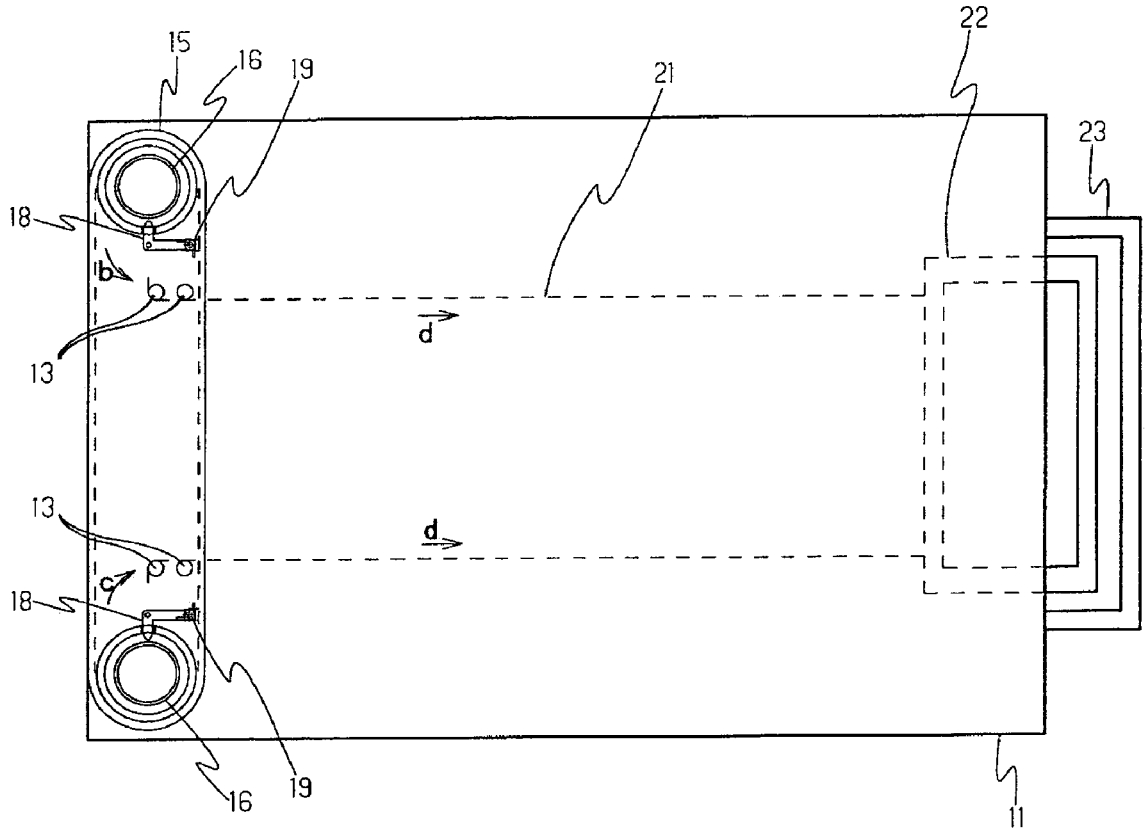
FIG. 7 is a plan view of the mounting member of the image forming apparatus.
Figure 8:
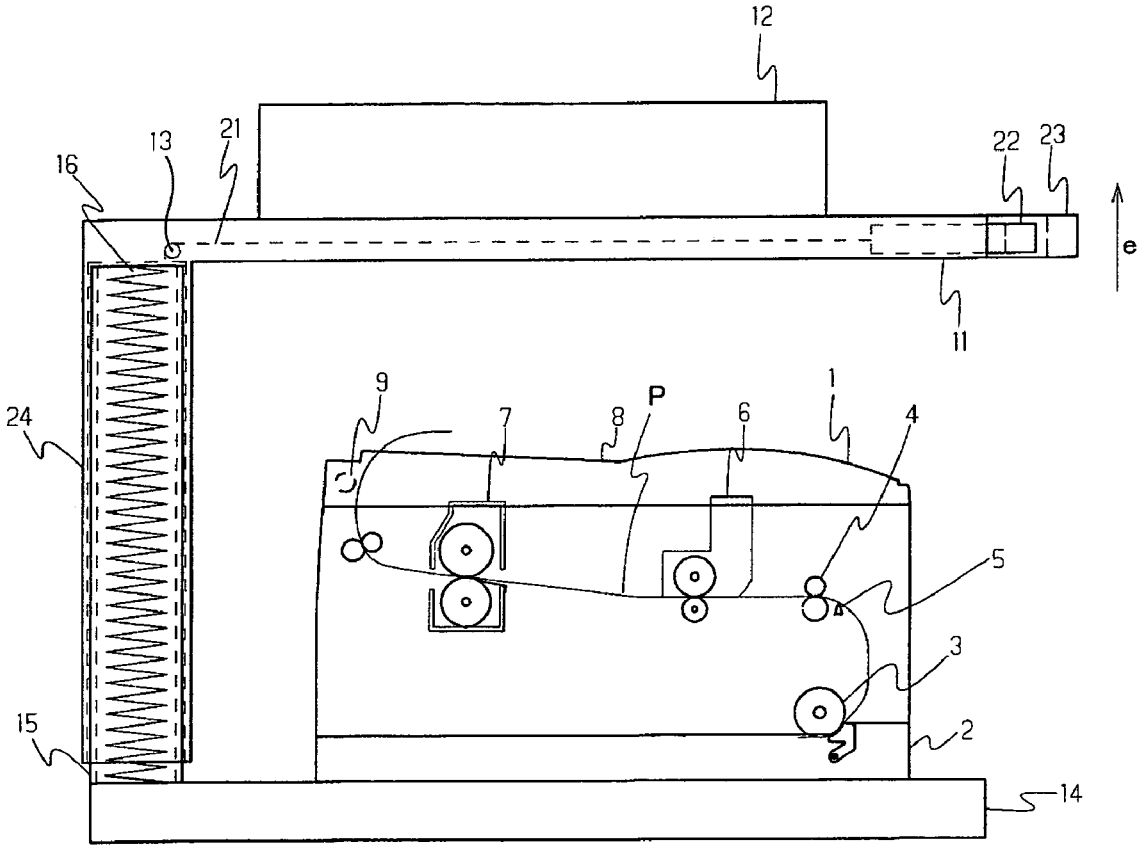
FIG. 8 is a side view of the mounting member of the image forming apparatus, showing a status of the mounting member in ordinary use.

The mounting member composed of the first and second mounting members is used as shown in FIG. 7 and FIG. 8 in a state where the prop 24 at the second mounting member is engaged with the prop 15 at the first mounting member. It is to be noted that FIG. 7 shows a plan view of the mounting member and FIG. 8 shows a side view of the mounting member.

That is, the printing apparatus 1 is mounted on the foundation 14 of the first mounting member as shown in FIG. 8. On the other hand, the scanning apparatus 12 is mounted on the mounting table 11 of the second mounting member formed above the foundation 14, configured as upward and downward movable with respect to the foundation 14. It is to be noted that those printing apparatus 1 and scanning apparatus are connected to each other via an interface cable, not shown, such as e.g., a USB (Universal Serial Bus) interface cable or the like, for transferring electrical signals. The printing apparatus 1 is configured to receive via the interface cable the image data read with the scanning apparatus 12 to make printing operation based on the image data.

Furthermore, the mounting member is formed with, as shown in FIG. 8, a pushing member 16 serving as a pushing section such as, e.g., a spring member or the like, for pushing upward the mounting table 11. The pushing member 16 is inserted into the interior portion of the prop 15 in a manner to have one end connected to the foundation 14 of the first mounting member and the other end connected to the joint part between the mounting table 11 and the prop 24 of the first mounting member. The pushing member 16 is set to have pushing force with which the mounting table 11 is moved to a higher position than that of the opening 17*a* formed in the prop 15 whereas not moved up to a position of the opening 17*b*.

With the above described mounting member, the front end portion of the level setting lever 18 is inserted into either the opening 17*a* or the opening 17*b* so that the mounting table 11 of the second mounting member is set at a level corresponding to either the opening 17*a* or the opening 17*b*, selectively. On the mounting member, for example, where the user uses the printing apparatus 1 or the scanning apparatus 12 in a normal operation, the mounting table 11 is set at a low position corresponding to the opening 17*a* in a state where the pushing member 16 is compressed. On the other hand, on the mounting member, the second mounting member is moved up in a direction of arrow e to set the mounting table 11 at a high position corresponding to the opening 17 b in a state where the pushing member 16 is stretched out in a case where the user opens the top cover 8 to make the maintenance operation of the printing apparatus 1 or the like, as shown FIG. 9. That is, the mounting member is configured to move upward and downward the mounting table 11 depending on a status of use of the printing apparatus 1 to render a distance between the mounting table 11 and the foundation 14 variable.

Figure 9:
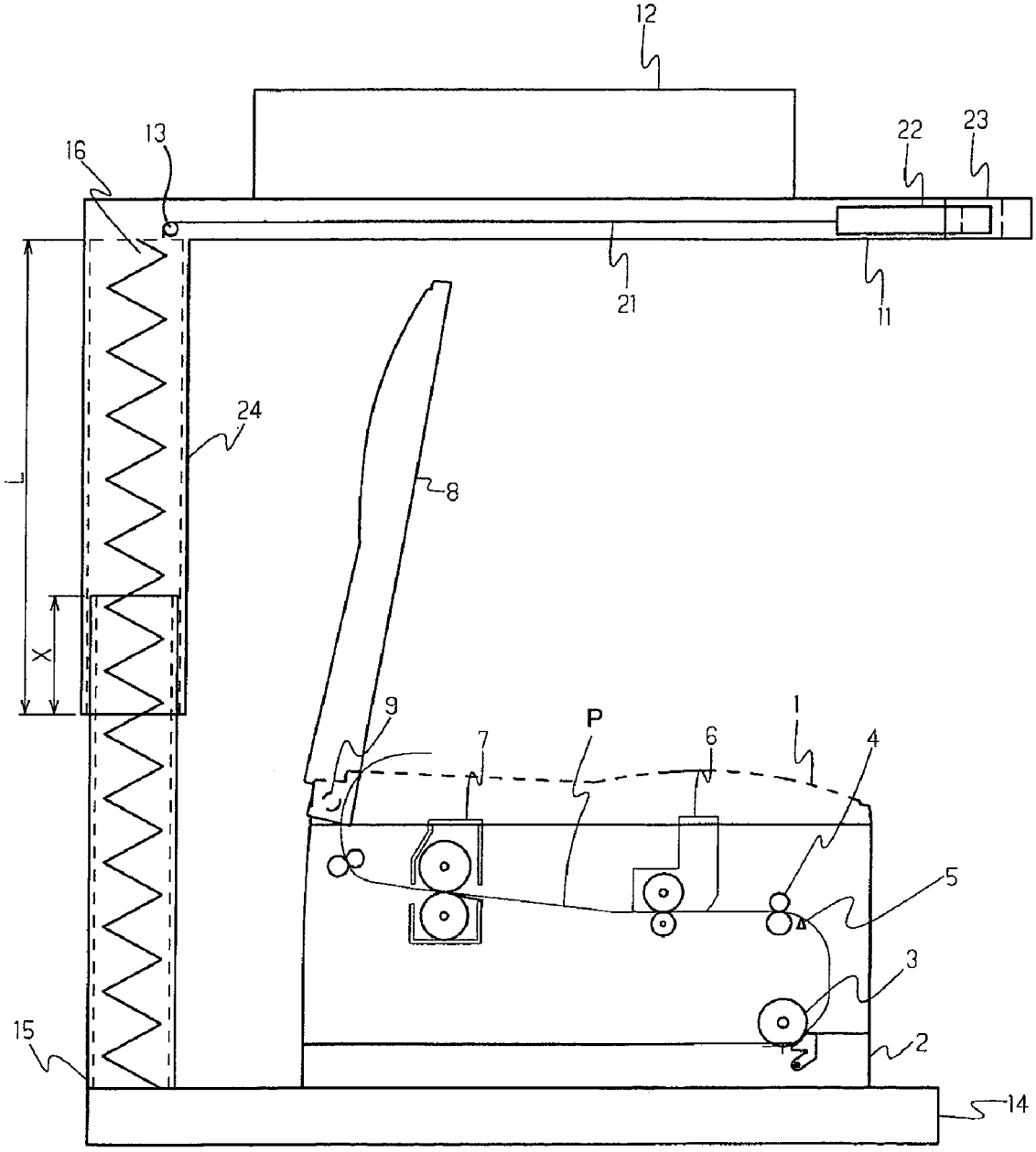

On the mounting member, where the mounting table 11 is set at a position corresponding to the opening 17*b* as shown in FIG. 9 on the condition that a portion at which the props 15, 24 are engaged and overlapped with each other has a length set to X whereas the prop 24 has a length set to L, an engagement rate X/L of the props 15, 24 is desirably set to more than or equal to fifty percent. Consequently, the mounting member can sustain sufficiently a weight of the scanning apparatus 12 whereas such an unexpected situation resulted from insufficient engagement between the props 15, 24 can be avoided that the prop 24 is disengaged from the prop 15 or failures occur in the upward and downward movement operation owing to the prop 24 in improper contact with the prop 15.

On the above described mounting member in an ordinary use, the level setting lever 18 is pushed with the spring member 19 and correspondingly, the front end portion of the level setting lever 18 is inserted into the opening 17*a*, as already shown in FIG. 7, so that the mounting table 11 is set at a low position corresponding to the opening 17*a*, as already shown in FIG. 8.

Figure 10:
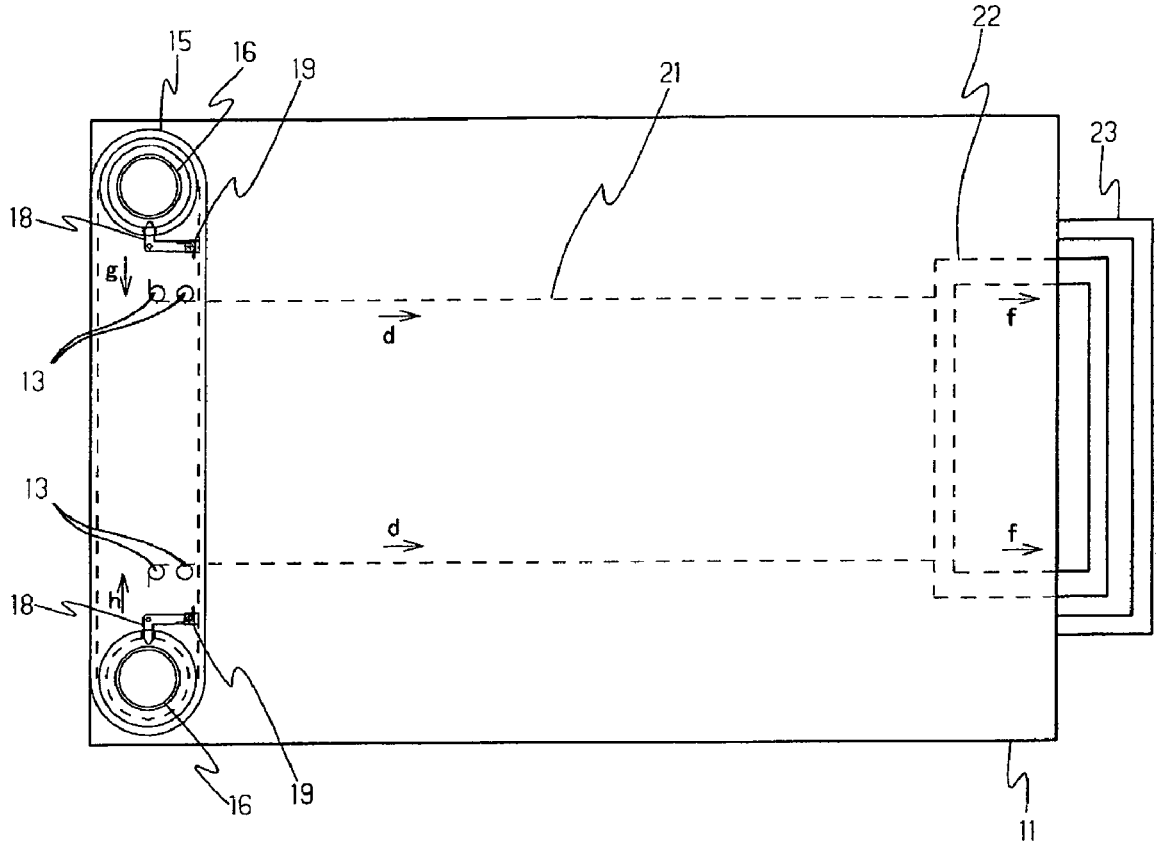
FIG. 10 is a plan view of the mounting member of the image forming apparatus, showing a status where a front end of a level setting lever is inserted in an opening.
Figure 11:
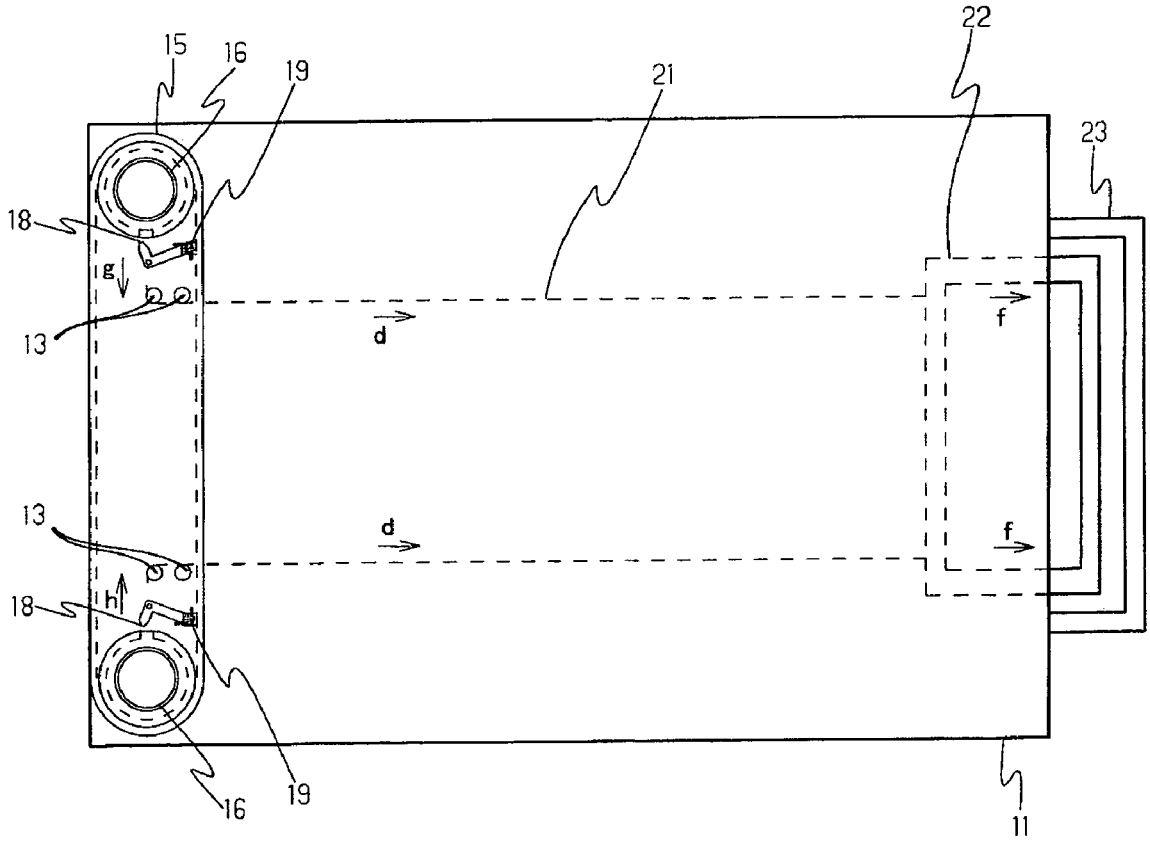
FIG. 11 is a plan view of the mounting member of the image forming apparatus, showing a status where a level set with the level setting lever is released.

Furthermore, on the mounting member, the user pulls the handle 22 in a direction of arrow r as shown in FIG. 10 with grabbing both of the handles 22, 23 as shown in FIG. 10 when bringing the top cover 8 of the printing apparatus 1 in an open status for the maintenance operation from a status at a time of an ordinary use where the mounting table 11 is set at a low position corresponding to the opening 17*a*. Therefore, on the mounting member, the wire 21 connected integrally to the handle 22 is pulled in a direction of arrow d shown in FIG. 10, and accordingly, the level setting levers 18 connected to the wire 21 are respectively rotated in directions of arrows g, h. On the mounting member, the level setting lever 18 inserted into the opening 17*a* is disengaged from the opening 17*a* as shown in FIG. 11, in accordance with rotation of the level setting lever 18, so that the level set with the level setting lever 18 is released and thus the mounting table 11 is moved upward by the pushing force with the pushing member 16 up to a predetermined position between the openings 17*a*, 17*b*. Herein, on the mounting member, the pushing force with the pushing member 16 is set to weaker than force required for moving upward the mounting table 11 up to the opening 17*b*. Thus, on the mounting member, the front end portion of the level setting lever 18 is inserted in the opening 17*b* and the mounting table 11 is set at a high position corresponding to the opening 17*b*.

On the mounting member, consequently, the distance between the mounting table 11 and the foundation 14 is extended, thereby being able to open the top cover 8 of the printing apparatus 1.

On the other hand, on the mounting member, the user closes the top cover 8 of the printing apparatus 1 and then pulls, as shown in FIG. 10, the handle 22 in a direction of arrow f shown in FIG. 10 with grabbing the handles 22, 23 where bringing the mounting member from a state where the mounting table 11 is set at a high position corresponding to the opening 17*b* back into a state at a time of an ordinary use. On the mounting member, the wire 21 connected integrally to the handle 22 is therefore pulled in a direction of arrow d shown in FIG. 10 and accordingly, the level setting levers 18 connected to the wire 21 are respectively rotated in directions of arrows g, h shown in FIG. 10. On the mounting member, the level setting lever 18 inserted into the opening 17*b* is disengaged as shown in FIG. 11 from the opening 17*b* in accordance with the self-rotation of the level setting lever 18, so that a level set with the level setting lever 18 is released and thus the mounting table 11 is moved downward to a prescribed position between the openings 17*b*, 17*a* because of the self-weight of the second mounting member. On the mounting member, the user grabs the handle 23 to move further downward the mounting table 11 in a downward direction, so that the front end portion of the level setting lever 18 is inserted into the opening 17*a* upon urging force with the spring member 19, thereby setting the mounting table 11 at a low position corresponding to the opening 17*a*.

As described above, with the image forming apparatus according to the first embodiment of this invention, with respect to a position of the mounting table 11 mounting the scanning apparatus 12 thereto, the mounting table 11 can be set at a position selectively switched between two positions, i.e., a position in ordinary use and a position allowing the top cover 8 to be open. Therefore, the image forming apparatus can be installed in such a limited space as non-extendable in horizontal direction since the mounting table 11 mounting the scanning apparatus 12 thereto is not rotated likewise the conventional image forming apparatus but moved upward and downward in a vertical direction.

Furthermore, with the image forming apparatus, the pushing member 16 supports force necessary for moving up the mounting table 11 and therefore, the mounting table 11 can be moved upward with minimal force.

Furthermore, with the image forming apparatus, the engagement rate between the first and second mounting members is set to fifty percent, thereby being able to use stably the image forming apparatus even in a state where the mounting table 11 is shifted.

The image forming apparatus according to the second embodiment is described hereinafter.

With the image forming apparatus according to the second embodiment, the pushing force with the pushing member 16 is strengthened in a manner to move upward the mounting table 11 up to a position allowing the top cover 8 of the printing apparatus 1 to be open, not up to a predetermined position between the openings 17*a*, 17*b* formed in the prop 15. Therefore, in description for the second embodiment, substantially the same structural portions as those in the first embodiment are assigned with the same reference number and those duplicated descriptions are omitted.

Figure 12:
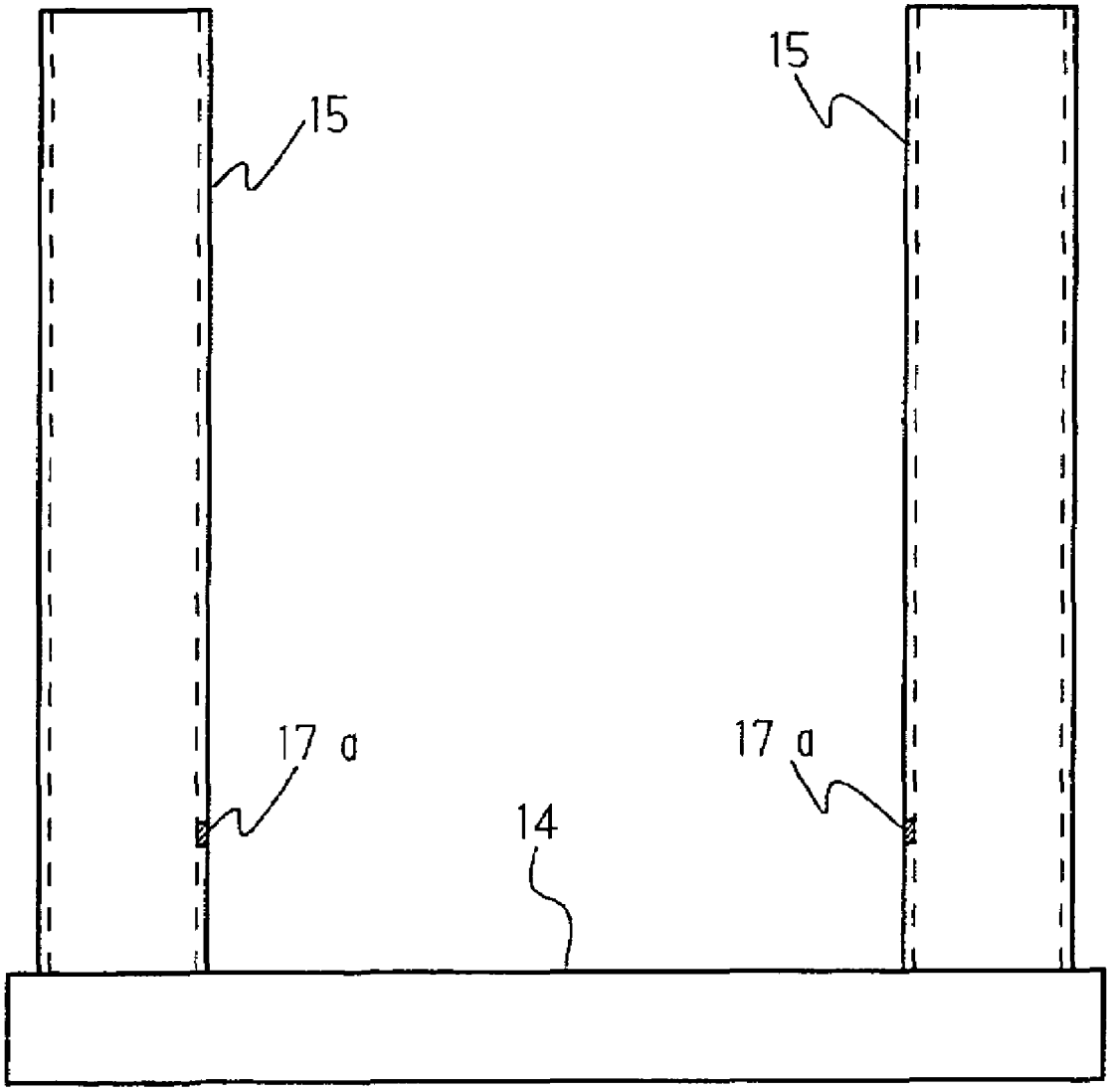
FIG. 12 is a rear view of a first mounting member composing a mounting member of an image forming apparatus according to a second embodiment of this invention.

FIG. 12 shows a rear view of the first mounting member composing the mounting member. That is, on the first mounting member, only one opening 17*a* is formed in a side surface of the prop 15 formed upright to the foundation 14. More specifically, the opening 17*a* is formed at only a low position of the side surface of the prop 15, at which the mounting table 11 is set at a time of ordinary use. On the other hand, the second mounting member has substantially the same structure as that in the first embodiment.

On the mounting member composed of the first and second mounting members, the pushing member 16 is set to have the pushing force so that the mounting table 11 can be shifted to a higher position than a position of the opening 17*a* formed to the prop 15, allowing the top cover 8 of the printing apparatus 1 in an open status. That is, on the mounting member, the pushing force with the pushing member 16 is set so that a position at which the mounting table 11 stands still upon balance between the pushing force with the pushing member 16 and a weight of both the second mounting member and the scanning apparatus 12 mounted on the second mounting member is equal to a position having a level enough to form a space to make the top cover 8 of the printing apparatus 1 open.

On the above described mounting member, the level setting lever 18 is pushed with the spring member 19 at a time of ordinary use and correspondingly, the front end portion of the level setting lever 18 is inserted into the opening 17*a*, as already shown in FIG. 7, so that the mounting table 11 is set at a low position corresponding to the opening 17*a*, as already shown in FIG. 17*a*.

Furthermore, on the mounting member, as shown in FIG. 10, the user pulls the handle 22 in a direction of arrow r with grabbing the handles 22, 23 where opening the top cover 8 of the printing apparatus 1 for the maintenance operation, from in a state at a time of ordinary use where the mounting table 11 is set at a low position corresponding to the opening 17*a*. Therefore, on the mounting member, the wire 21 connected integrally to the handle 22 is pulled in a direction of arrow d and accordingly, the level setting levers 18 connected to the wire 21 are respectively rotated in directions of arrows g, h. On the mounting member, the level setting lever 18 inserted into the opening 17*a* is disengaged from the opening 17*a* as already shown in FIG. 11, in accordance with rotation of the level setting lever 18, so that the level set with the level setting lever 18 is released and thus the mounting table 11 is moved upward by the pushing force with the pushing member 16 up to a position allowing the top cover 8 of the printing apparatus 1 to be open.

On the mounting member, consequently, the distance between the mounting table 11 and the foundation 14 is extended, thereby being able to open the top cover 8 of the printing apparatus 1.

On the other hand, the user closes the top cover 8 of the printing apparatus 1 to grab the handles 22, 23 or pushes downward the upper surface of the mounting table 11 to move downward the mounting table 11 upon addition of the weight in a downward direction where bringing the mounting member from a state where the mounting table 11 is shifted up to a position having a level allowing the top cover 8 of the printing apparatus 1 to be open back into a state for ordinary use. Consequently, on the mounting member, the front end portion of the level setting lever 18 is inserted into the opening 17*a* upon reception of urging force with the spring member 19, thereby setting the mounting table 11 at a low position corresponding to the opening 17*a*.

As described above, on the image forming apparatus according to the second embodiment, the pushing member 16 is set to have the pushing force in a manner to move upward the mounting table 11 up to a position allowing the top cover 8 of the printing apparatus 1 to be open, so that the user can move upward the mounting table 11 only by operating the level setting lever 18 upon grabbing the handles 22, 23 whereas not needing to operate the level setting lever 18 in a case of moving downward the mounting table 11. Therefore, this image forming apparatus has an effect that the user with even weak strength can make operation easily, in addition to the effect according to the first embodiment.

It is to be noted that in the second embodiment, a position at which the mounting table 11 stands still is set to a position allowing the top cover 8 of the printing apparatus 1 to be open but the mounting table 11 may be set at an upper position, as brought in contact with stoppers by the pushing member on the condition that predetermined stoppers are formed to the props 15, 24.

The image forming apparatus according to the third embodiment is described next.

On the image forming apparatus according to the third embodiment, the mounting table 11 is moved up depending on opening operation for the top cover 8, not likewise the image forming apparatus according to the first and second embodiments, in which the opening operation for the top cover 8 of the printing apparatus 1 is implemented after moving upward the mounting table 11. Therefore, in the third embodiment, substantially the same structural portions as those in the first and second embodiments are assigned with the same reference number and those duplicated descriptions are omitted.

Figure 13:
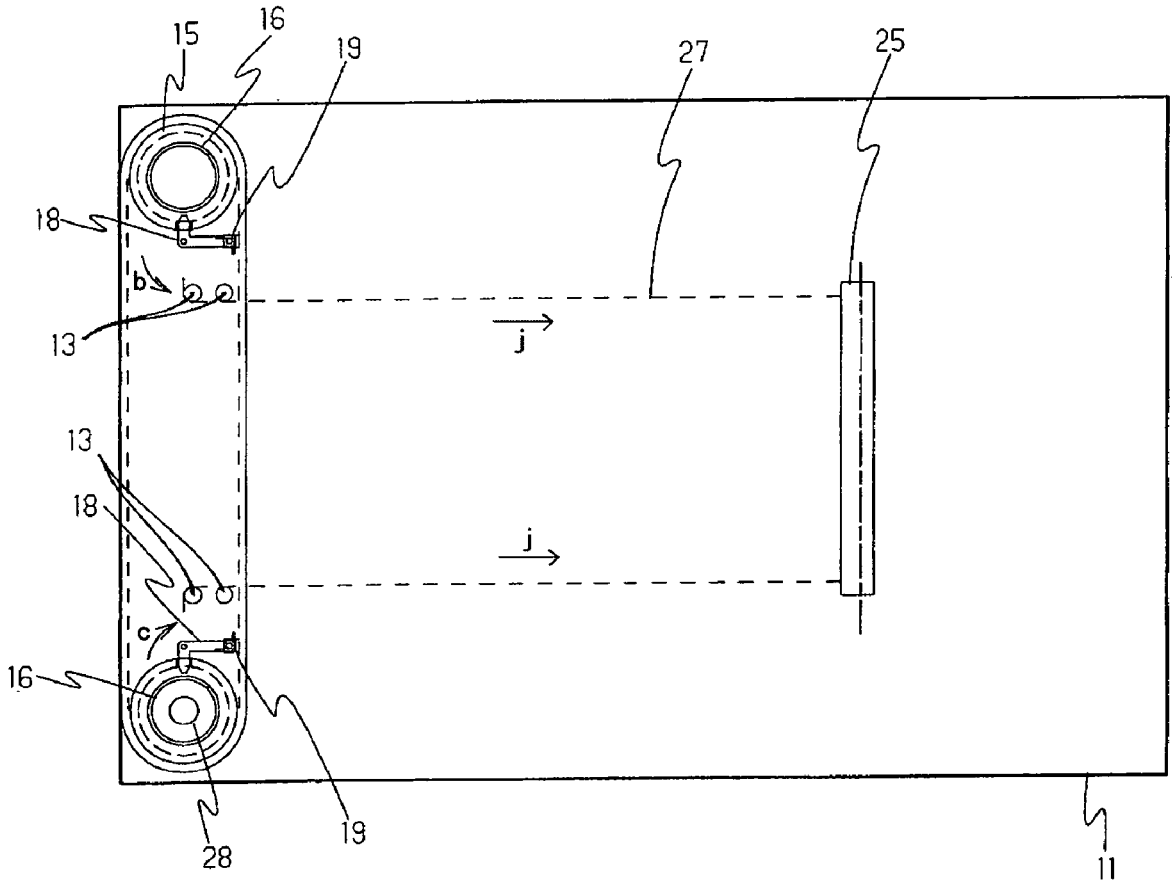
FIG. 13 is a plan view of a mounting member of an image forming apparatus according to a third embodiment.

FIG. 13 shows a plan view of the mounting member. On the mounting member, likewise the second embodiment, only one opening 17*a*, not shown in particular, is formed in the side surface of the prop 15 formed upright to the foundation 14 of the first mounting member. That is, likewise the second embodiment, on the mounting member, the pushing force with the pushing member 16 is strengthened in a manner to move upward the mounting table 11 up to a position allowing the top cover 8 of the printing apparatus 1 to be open.

Figure 14:
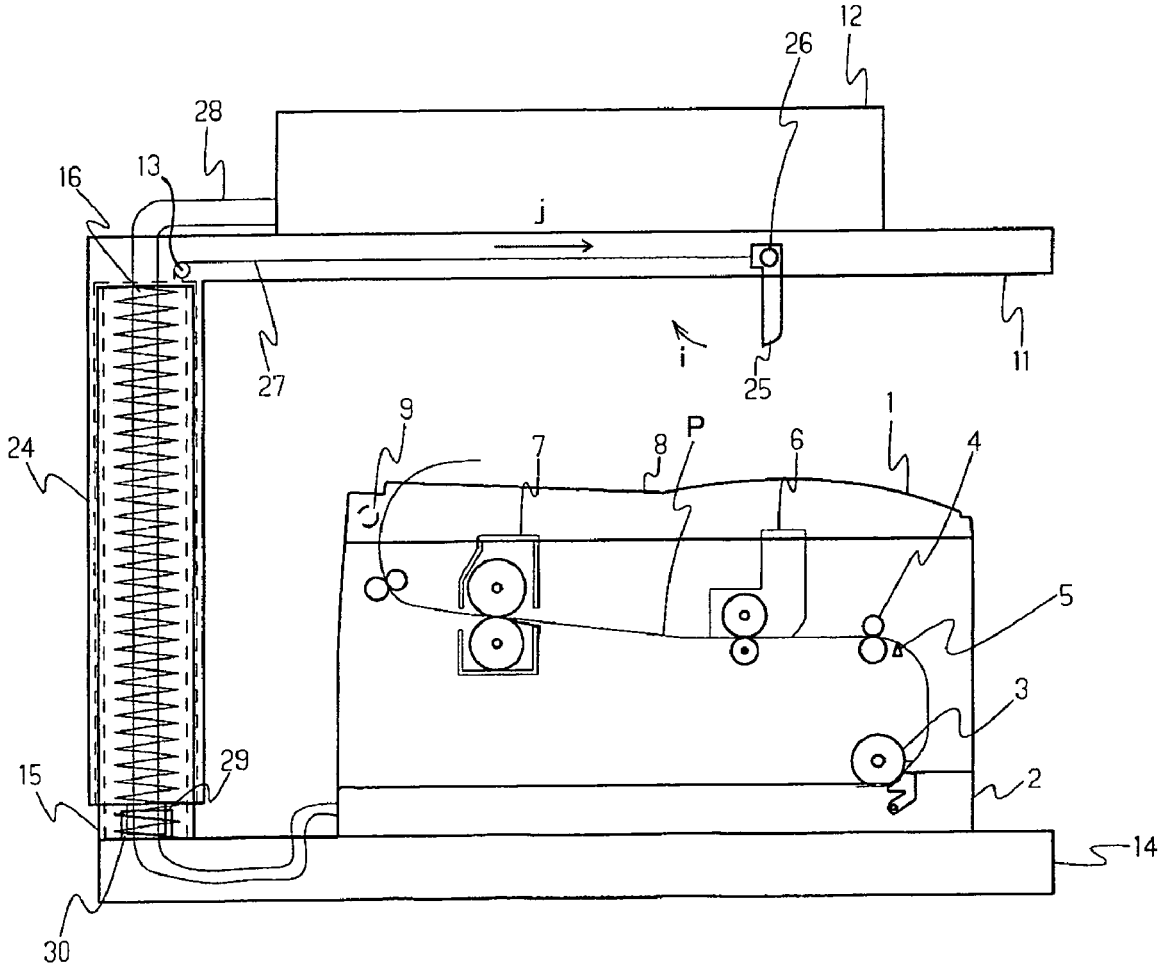
FIG. 14 is a side view of the mounting member of the image forming apparatus, showing a status of the mounting member in ordinary use.

Furthermore, on the mounting member, the mounting table 11 of the second mounting member is formed with a lever member 25 serving as a movable member for moving upward the mounting table in association with opening of the top cover 8 of the printing apparatus 1. More specifically, as FIG. 14 show a side view of the mounting member, the lever member 25 is formed as projecting to a surface of the mounting table 11, opposite to a surface mounting the scanning apparatus 12 thereto and is configured as rotatable in a direction of arrow i as shown in FIG. 14 around a center 26 as a center of rotation. The second mounting member is arranged with a wire 27 having one end connected to the level setting lever 18. Likewise the wire 21 as described above, the wire 27 is arranged in a perpendicular direction along from the level setting lever 18 to the prop 24 as well as arranged in a horizontal direction along the mounting table 11 via the supporting member 13 formed at the vicinity of the joint part between mounting table 11 and the prop 24. The other end of wire 27 is connected as integrally movable to the lever 25 formed at the mounting table 11. This wire 27 is pulled in a direction of arrow j shown in FIG. 14 upon rotation of the lever member 25 in a direction of the arrow i show in FIG. 14, thereby being operated in a manner to rotate the level setting lever 18 connected to one end of the wire 27 in directions of arrows b, c shown in FIG. 14.

On the mounting member as described above, the printing apparatus 1 is mounted on the foundation 14 of the first mounting member whereas the scanning apparatus 12 is mounted on the mounting table 11 of the second mounting member. Those printing apparatus 1 and scanning apparatus 12 are connected to each other via a predetermined cable 28. More specifically, this cable 28 is formed as extending from the scanning apparatus 12, as inserted into the interior portion of the prop 15 of the first mounting member, and has a connector 29 formed to an front end portion not connected to the scanning apparatus 12. This cable 28 engages the connector 29 with a connector 30 defined as a front end of a predetermined cable extending from the printing apparatus 1, installed at a lower end portion of the prop 15 of the first mounting member, thereby connecting electrically the printing apparatus 1 to the scanning apparatus 12.

When using the above described mounting member ordinary, the front end of the level setting lever 18 is, as shown in FIG. 13, inserted into the opening 17*a* as the level setting lever 18 is pushed with the spring member 19, so that the mounting table 11 is set at a low position corresponding to the opening 17*a* as shown in FIG. 14.

Figure 15:
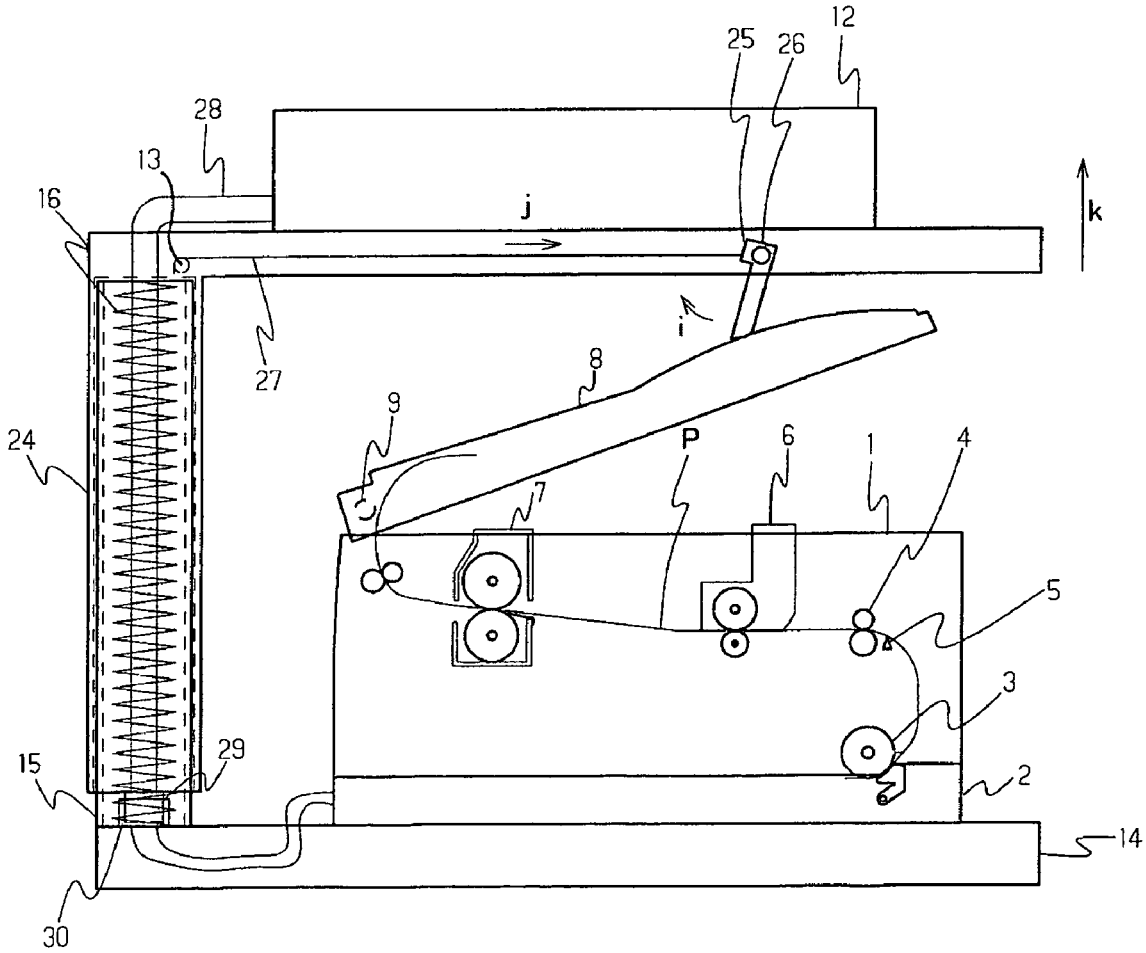
FIG. 15 is a side view of the mounting member of the image forming apparatus, showing a status where an upper surface of a top cover of a printing apparatus is in contact with a lever member.

Furthermore, on the mounting member, the user first opens the top cover 8 when opening the top cover 8 of the printing apparatus 1 for the maintenance operation or the like, from in a state for ordinary use, where the mounting table 11 is set at a low position corresponding to the opening 17*a*. Therefore, on the mounting member, the upper surface of the top cover 8 becomes in contact with the lever member 25, as shown in FIG. 15, so that the rotation force in the direction of the arrow i is exerted on the lever member 25. Consequently, the wire 27 connected integrally to the lever member 25 is pulled in a direction of arrow j shown in FIG. 15 in accordance with rotation of the lever member 25 and accordingly, the level setting lever 18 connected to the wire 27 is rotated in directions of arrows b, c, as shown in FIG. 13. Furthermore, on the mounting member, the level setting lever 18 inserted into the opening 17*a* is disengaged from the opening 17*a* in accordance with rotation of the level setting lever 18, so that the a level set with the level setting lever 18 is released and the mounting table 11 is moved upward in a direction of arrow k shown in FIG. 15 by the pushing force with the pushing member 16.

Figure 16:
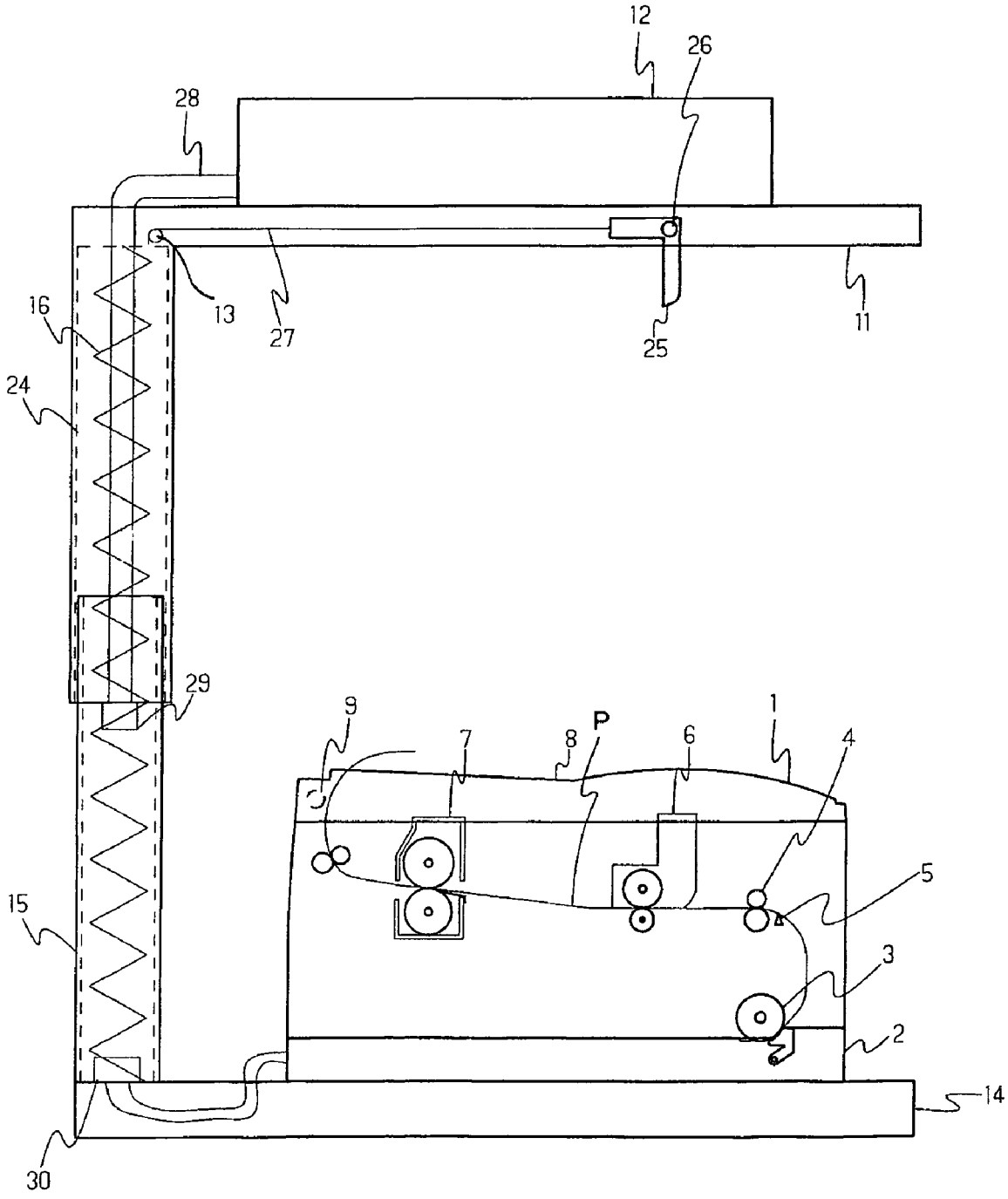

Thus, on the mounting member, a distance between the mounting table 11 and the foundation 14 is extended, thereby being able to open the top cover 8 of the printing apparatus 1 as shown in FIG. 16. In this bout, the connectors 29, 30 are disengaged from each other in accordance with upward movement of the mounting table 11.

On the other hand, the user closes the top cover 8 of the printing apparatus 1 and then moves downward the mounting table 11 by pushing downward the upper surface of the mounting table 11 where bringing the mounting member from a state where the mounting table 11 is moved up to a position allowing the top cover 8 of the printing apparatus 1 to be open back into a state for ordinary use. Therefore, the spring member 19 exerts urging force enough to insert the front end portion of the level setting lever 18 into the opening 17*a* and thus the mounting table 11 is set at a low position corresponding to the opening 17*a*. Accordingly, on the mounting member, the connectors 29, 30 are engaged into each other, so that the printing apparatus 1 and the scanning apparatus 12 are connected electrically to each other.

As described above, on the image forming apparatus according to the third embodiment of this invention, the mounting table 11 can be moved upward only upon a operation for opening the top cover 8 of the printing apparatus 1.

Therefore, this image forming apparatus has an effect that the operation imposed on the user at a time of the maintenance operation or the like can be reduced, in addition to the effects according to the first and second embodiments. Furthermore, with this image forming apparatus, the cable does not need a surplus length required for movement of the mounting table 11 since the connectors 29, 30 are disengaged from each other where the mounting table 11 is moved upward.

The image forming apparatus according to the fourth embodiment is described at the last.

On the image forming apparatus according to the fourth embodiment, the top cover 8 is automatically closed, not likewise the image forming apparatus according to the first, second, and third embodiments in which the user closes the top cover 8 voluntarily, at a time of downward movement of the mounting table 11. Therefore, in the fourth embodiment, substantially the same structural portions as those in the first, second, and third embodiments are assigned with the same reference number and those duplicated descriptions are omitted.

Figure 17:
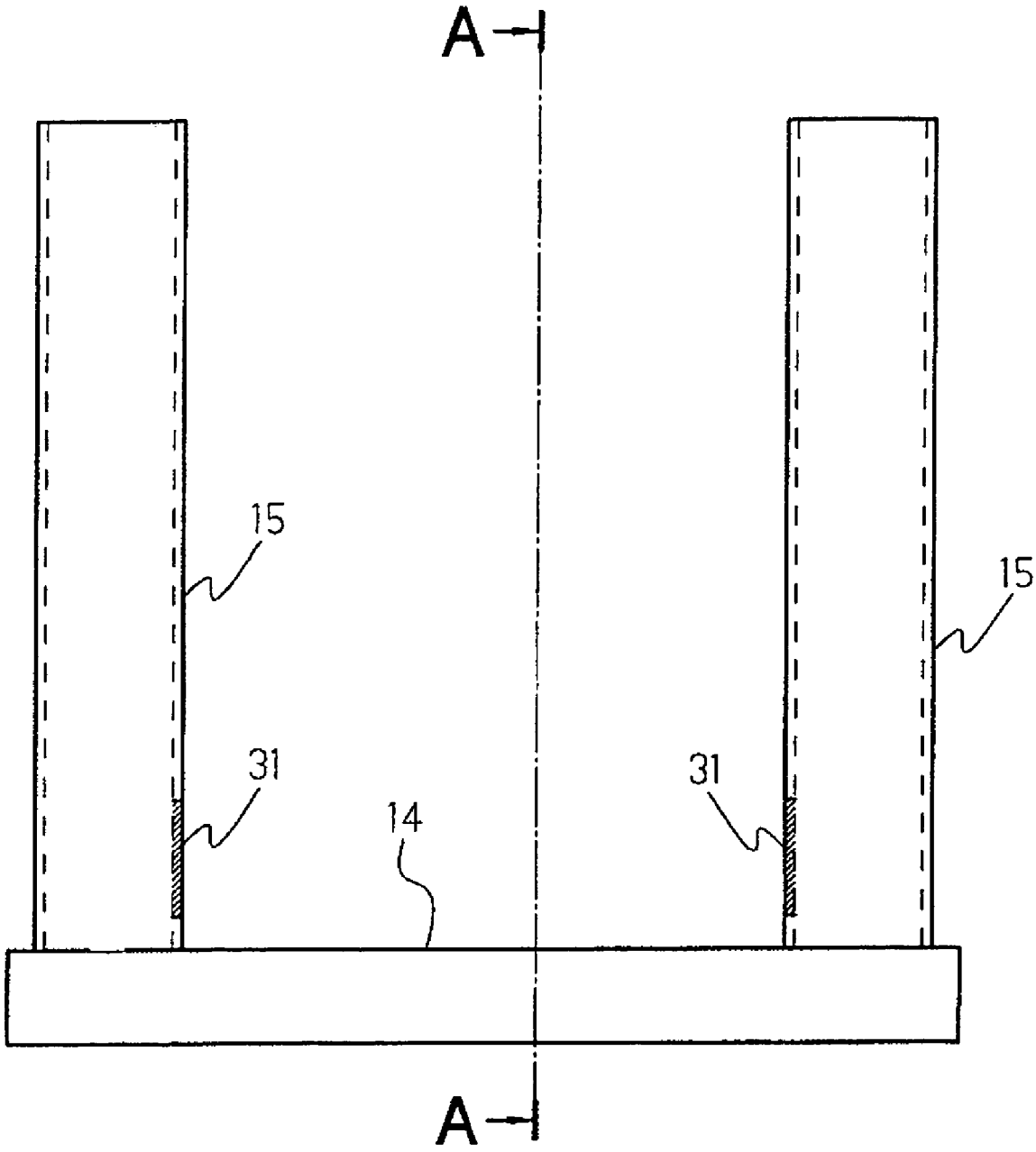
FIG. 17 is a rear view of a first mounting member composing a mounting member of an image forming apparatus according to a fourth embodiment of this invention.
Figure 18:
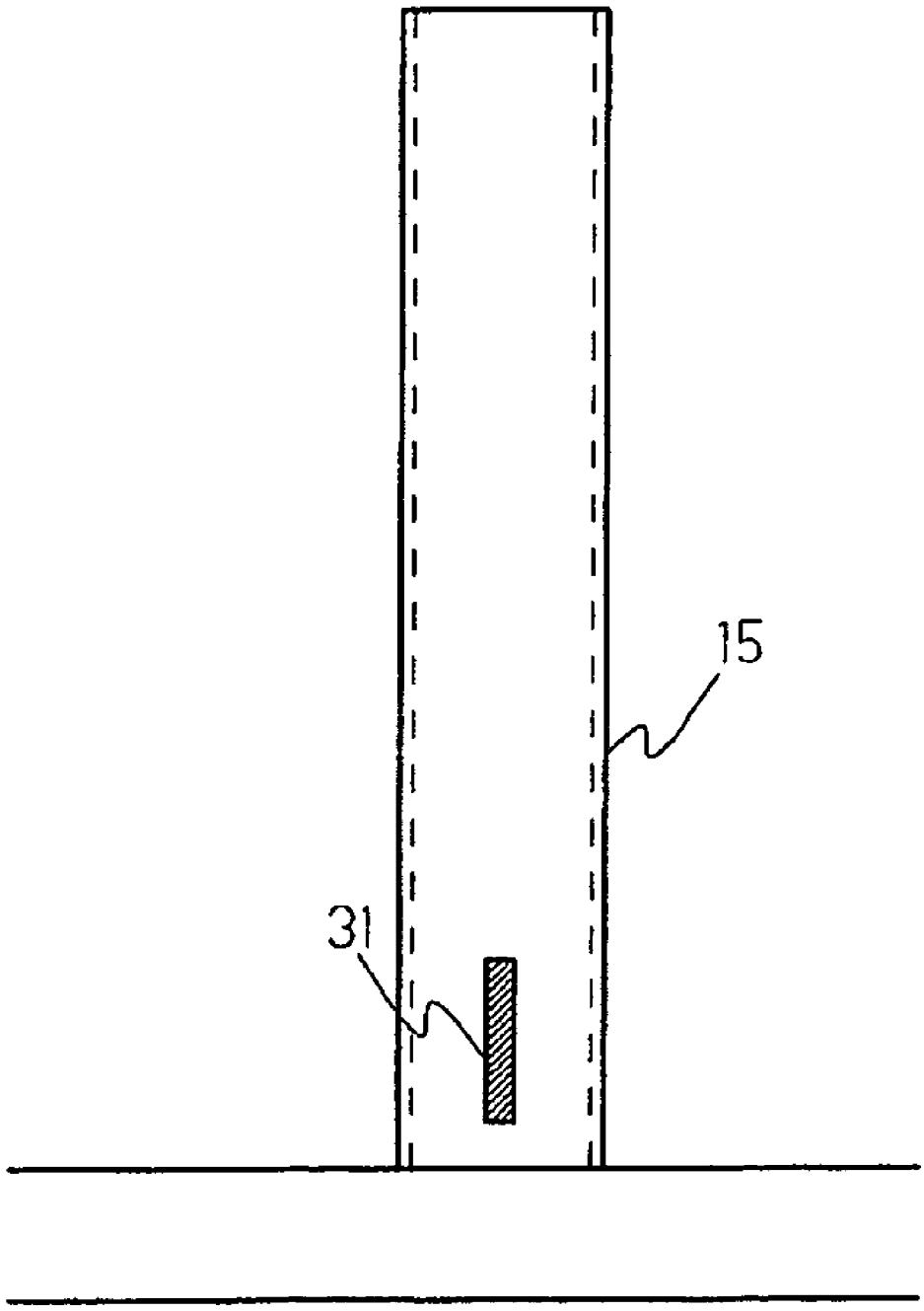
FIG. 18 is a cross-sectional view along a line A-A shown in FIG. 17, showing an essential part of the first mounting member composing the mounting member of the image forming apparatus.
Figure 19:
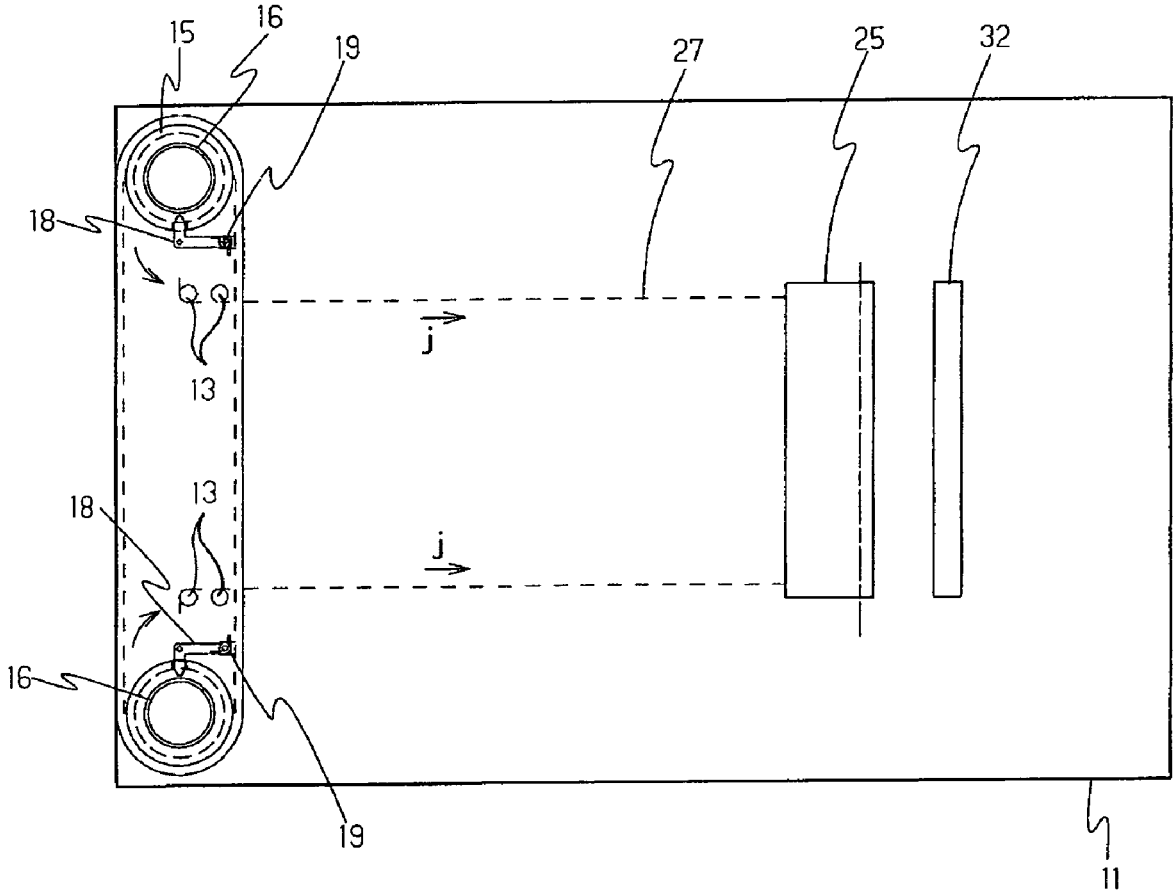
FIG. 19 is a plan view of the mounting member of the image forming apparatus.

FIG. 17 shows a rear view of the first mounting member. FIG. 18 shows a cross-sectional view along a line A-A of the first mounting member. FIG. 19 shows a plan view of the mounting member. That is, on the mounting member, an opening 31 in a vertically long shape is formed, instead of the above described opening 17 set in a shape allowing only the front end portion of the level setting lever 18 to be inserted therein, in the side surface of the prop 15 formed upright to the foundation 14 of the first mounting member. More specifically, the opening 31 is formed in a vertically long shape extending in upward and downward directions with respect to a center set to a position of the opening 17*a* formed at a low position at which the mounting table 11 is set at a time of ordinary use. It is to be noted that on the mounting member, the pushing force with the pushing member 16 is strengthened in manner to move upward the mounting table 11 up to a position allowing the top cover 8 of the printing apparatus 1 to be open, likewise the mounting member according to the second and third embodiments.

On the mounting member, the mounting table 11 of the second mounting member is formed with a convex member 32 serving as a closing member for closing the top cover 8 of the printing apparatus 1 in an open status in accordance with downward movement of the mounting table 11. More specifically, the convex member 32 is formed as projecting to a surface of the mounting table 11, opposite to a surface mounting the scanning apparatus 12 thereto.

Figure 20:
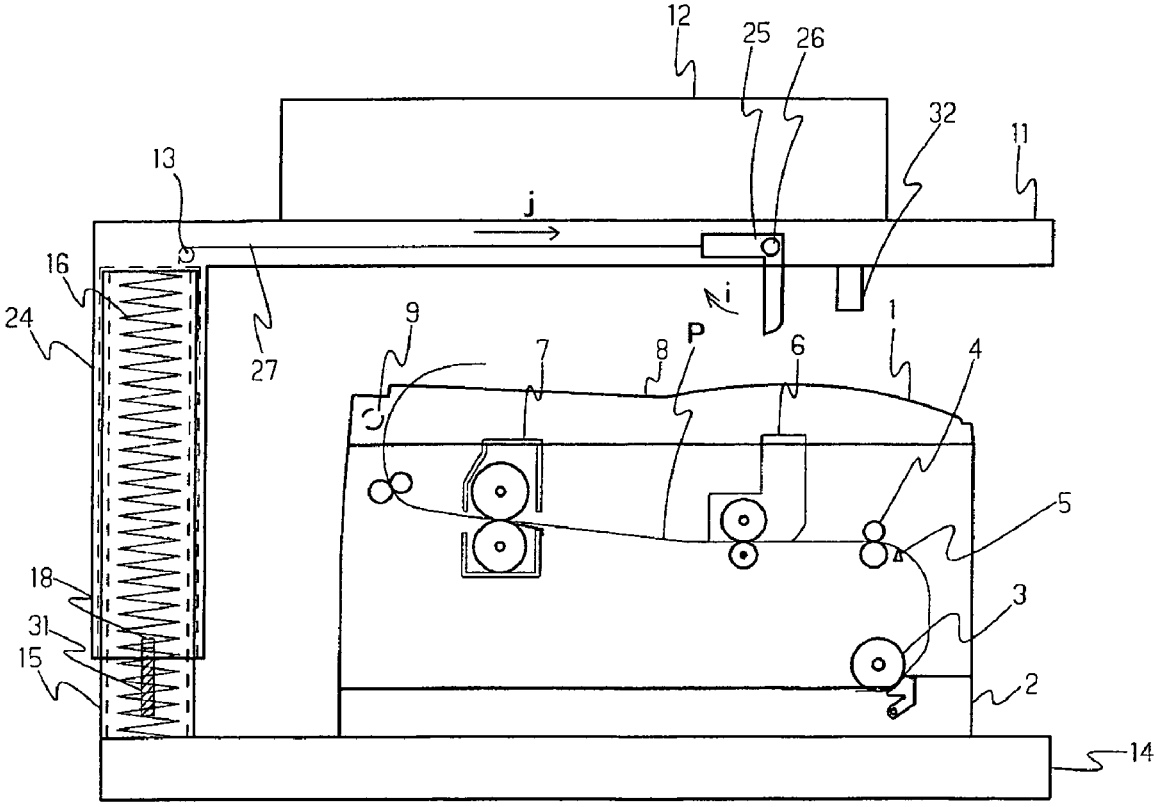
FIG. 20 is a side view of the mounting member of the image forming apparatus, showing the mounting member in ordinary use.

On the above described mounting member, since the mounting table 11 is pushed upward with the pushing member 16, the front end portion of the level setting lever 18 is inserted into the opening 31 at a position at which the front end portion of the level setting lever 18 is in contact with an upper end of the opening 31 in a vertically long shape as shown in FIG. 19, so that the mounting table 11 is set at a low position corresponding to the opening 31 as shown in FIG. 20.

Figure 21:
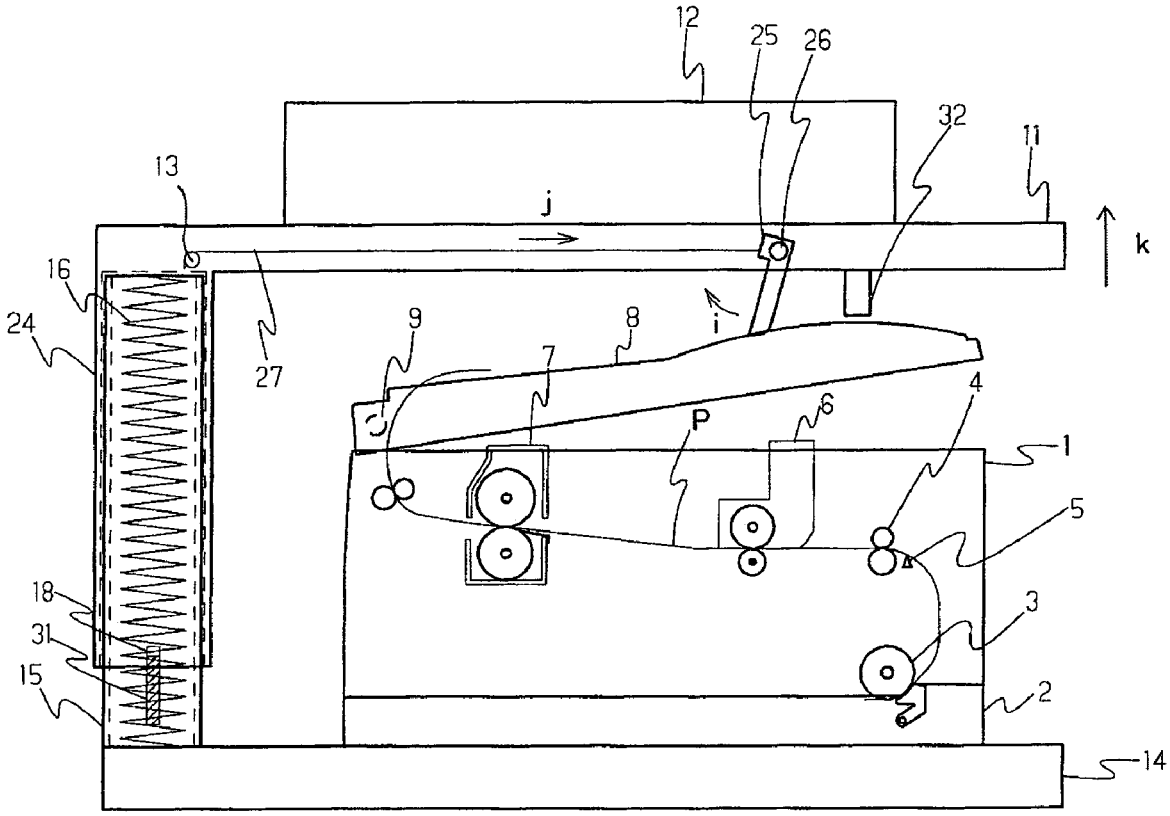
FIG. 21 is a side view of the mounting member of the image forming apparatus, showing a status where a top cover of a printing apparatus is made open.

On the mounting member, the user opens first the top cover 8 where opening the top cover 8 of the printing apparatus 1 to make the maintenance operation or the like from in a status for ordinary use, where the mounting table 11 is set at a low position corresponding to the opening 31. On the mounting member, the upper surface of the top cover 8 is therefore in contact with the lever member 25 as shown in FIG. 21, so that rotation force in a direction of the arrow i shown in FIG. 21 is exerted on the lever member 25. On the mounting member, consequently, the wire 27 connected integrally to the lever member 25 is pulled in a direction of arrow j shown in FIG. 21 in accordance with rotation of the lever member 25 and accordingly, the level setting lever 18 connected to the wire 27 is rotated in directions of arrows b, c shown in FIG. 19. On the mounting member, furthermore, since the level setting lever 18 inserted into the opening 31 is disengaged from the opening 31 according to the rotation of the level setting lever 18, a level set with the level setting lever 18 is released and thus, the mounting table 11 is moved upward in a direction of arrow k shown in FIG. 21 by the pushing force with the pushing member 16.

On the mounting member, therefore, a distance between the mounting table 11 and the foundation 14 is extended, thereby being able to open the top cover 8 of the printing apparatus 1.

Figure 22:
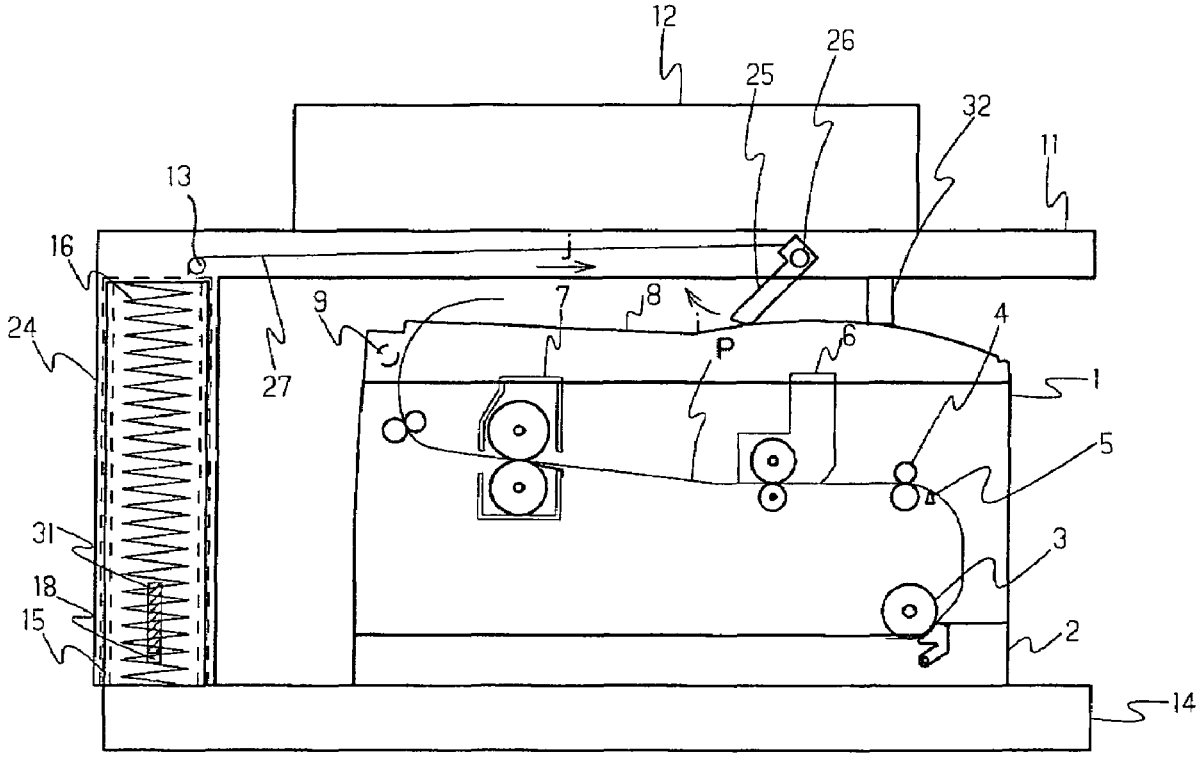
FIG. 22 is a side view of the mounting member of the image forming apparatus, showing a status where an upper surface of the top cover of the printing apparatus is pushed down with a convex member.
Figure 23:
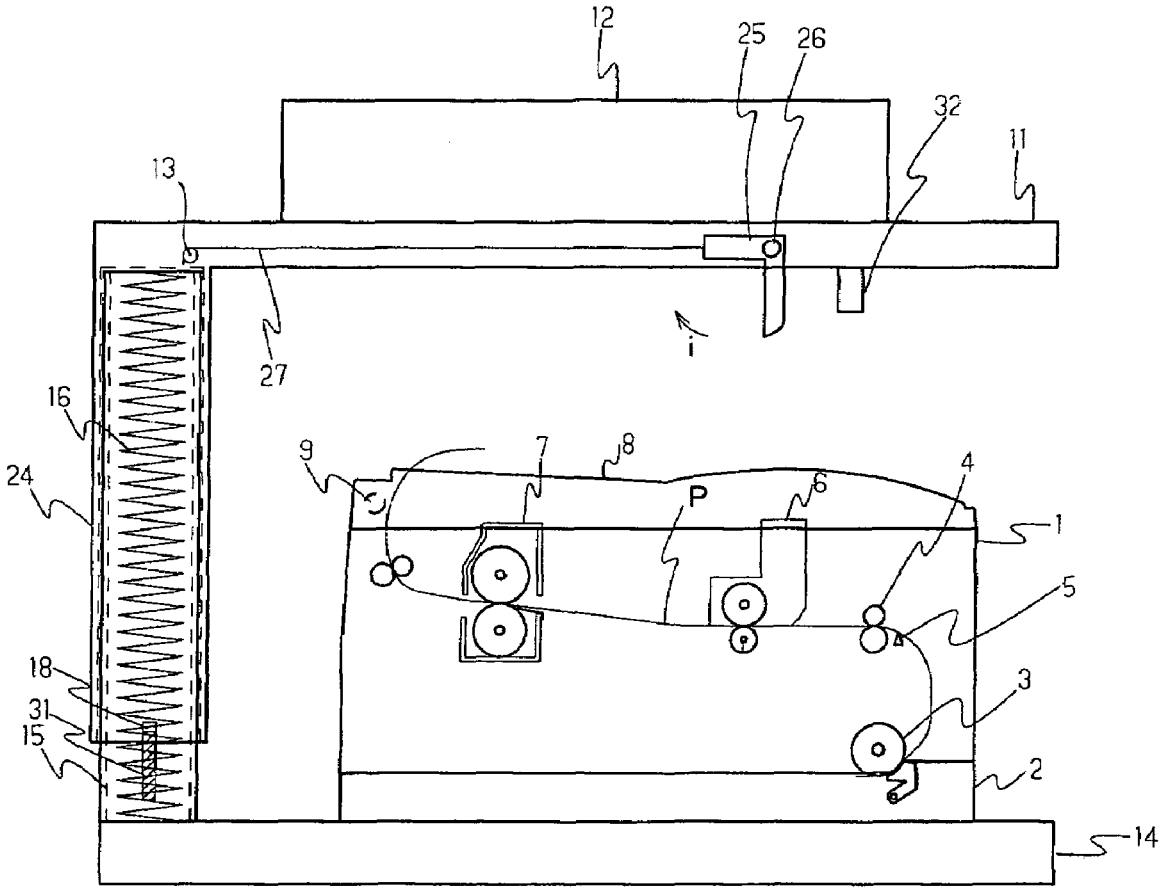
FIG. 23 is a side view of the mounting member of the image forming apparatus, showing a status where a lever member is put back to an original place.

On the other hand, on the mounting member, the user moves downward the mounting table 11 by pushing downward the upper surface of the mounting table 11 where bringing the mounting member from a state where the mounting table 11 is moved up to a position allowing the top cover 8 of the printing apparatus 1 to be open back into a state for ordinary use. On the mounting member, the front end portion of the level setting lever 18 is therefore inserted into the opening 31 by the urging force with the spring member 19 but the mounting table 11 can be moved further downward since the opening 31 is formed in a vertically long shape. On the mounting member, the upper surface of the top cover 8 of the printing apparatus 1 is correspondingly pushed downward with the convex member 32 as shown in FIG. 22 and thus the top cover 8 is closed. Furthermore, on the mounting member, the user looses his force required for pushing downward the mounting member, so that the mounting table 11 is pushed upward with the pushing member 16 and thus the front end portion of the level setting lever 18 is inserted into the opening 31 at a position at which the above front end portion is in contact with a lower end of the opening 31 in a vertically long shape, thereby being pushed up to an upper end of the opening 31 by the urging force with the spring member 19. On the mounting member, as shown in FIG. 23, the mounting table 11 is therefore set at a low position corresponding to the opening 31. In this bout, on the mounting member, the lever member 25 is also to be put back to an original place.

As described above, with the image forming apparatus according to the fourth embodiment of this invention, the mounting table 11 can be moved upward only upon operation for opening the top cover 8 of the printing apparatus 1 whereas the top cover 8 can be closed at the same time of operation for pushing downward the mounting table 11. The image forming apparatus therefore has an effect to reduce operation for opening and closing the top cover 8 at a time of the maintenance operation or the like, in addition to the effect according to the first, second, and third embodiments.

It is to be noted that this invention is not limited to the above described embodiments. In description for those embodiments, for example, the printing apparatus is exemplified as the image forming unit but this invention can be applied to a photocopying apparatus, a facsimile apparatus, or the like, as long as those apparatus are defined as an image forming apparatus formed with the image forming unit and the image reading unit independently.

Furthermore, in the above described embodiments, the printing apparatus is described as mounted on the foundation in a flat plate shape whereas the scanning apparatus is described as mounted on the mounting table in a flat plate shape but the mounting members not only in the flat plate shape but also in any forms such as, e.g., an arm shape, or the like can be applicable as the first mounting member for mounting the printing apparatus and the second mounting member for mounting the scanning apparatus, as long as the mounting member can mount thereon the printing apparatus or the scanning apparatus.

This invention can be arbitrarily modified without departing from the scope of this invention.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention should not be limited by the specification, but be defined by the claims set forth below.

What is claimed is:

1. An image forming apparatus having an image reading unit for reading optically an image on an original document and an image forming unit for forming said image on a recording medium based on image information read with said image reading unit comprising:

a mounting member including a first mounting member mounting said image forming unit thereto and a second mounting member mounting said image reading unit thereto, said second mounting member being formed above said first mounting member and being movable up and down with respect to said first mounting member;

a pushing section for pushing upward said second mounting member;

a level setting section for setting said second mounting member at plural prescribed levels;

a releasing section for releasing a level set by said level setting section; and an upward moving section for moving upward said second mounting member in association with opening of a cover for opening and closing an upper surface of said image forming unit;

wherein said level setting section sets selectively said image reading unit at either a first level at which said image reading unit is ordinarily used or a second level, higher than said first level, at which a top cover of said image forming unit can be opened;

wherein said pushing section is set to have a pushing force to move upward said second mounting member where said releasing section releases said level set at said first level with said level setting section as well as to move downward said second mounting member where said releasing section releases said level set at said second level with said level setting section;

and wherein said releasing section has a wire connecting a distant location and said releasing section so that said level set by said level setting section is released by operation of said wire at said distant location.

2. An image forming apparatus having an image reading unit for reading optically an image on an original document and an image forming unit for forming said image on a recording medium based on image information read with said image reading unit comprising:

a mounting member including a first mounting member mounting said image forming unit thereto and a second mounting member mounting said image reading unit thereto, said second mounting member being formed above said first mounting member and being movable up and down with respect to said first mounting member;

a pushing section for pushing upward said second mounting member;

a level setting section for setting said second mounting member at plural prescribed levels;

a releasing section for releasing a level set by said level setting section; and a cover closing section for closing in association with downward movement of said second mounting member said cover for opening and closing said upper surface of said image forming unit in an open status;

wherein said level setting section sets selectively said image reading unit at either a first level at which said image reading unit is ordinarily used or a second level, higher than said first level, at which a top cover of said image forming unit can be opened;

wherein said pushing section is set to have a pushing force to move upward said second mounting member where said releasing section releases said level set at said first level with said level setting section as well as to move downward said second mounting member where said releasing section releases said level set at said second level with said level setting section;

and wherein said releasing section has a wire connecting a distant location and said releasing section so that said level set by said level setting section is released by operation of said wire at said distant location.

3. An image forming apparatus mounting member, for mounting thereon an image forming apparatus having an image reading unit for reading optically an image on an original document and an image forming unit for forming said image on a recording medium based on image information read with said image reading unit comprising: a first mounting table for mounting thereon said image forming unit; a second mounting table for mounting thereon said image reading unit, said second mounting table being formed above said first mounting table and being movable up and down with respect to said first mounting table; a pushing section for pushing upward said second mounting table; a level setting section for setting said second mounting table at plural prescribed levels; a releasing section for releasing a level set by said level setting section; and a movable member for moving upward said second mounting table in association with opening of a cover for opening and closing an upper surface of said image forming unit; wherein said level setting section sets selectively said image reading unit at either a first level at which said image reading unit is ordinarily used or a second level, higher than said first level, at which a top cover of said image forming unit can be opened; wherein said pushing section is set to have a pushing force to move upward said second mounting table where said releasing section releases said level set at said first level with said level setting section as well as to move downward said second mounting table where said releasing section releases said level set at said second level with said level setting section; and wherein said releasing section has a wire connecting a distant location and said releasing section so that said level set by said level setting section is released by operation of said wire at said distant location.

4. An image forming apparatus mounting member for mounting thereon an image forming apparatus having an image reading unit for reading optically an image on an original document and an image forming unit for forming said image on a recording medium based on image information read with said image reading unit comprising: a first mounting table for mounting thereon said image forming unit; a second mounting table for mounting thereon said image reading unit, said second mounting table being formed above said first mounting table and being movable up and down with respect to said first mounting table; a pushing section for pushing upward said second mounting table; a level setting section for setting said second mounting table at plural prescribed levels; a releasing section for releasing a level set by said level setting section; and a closing section for closing in association with downward movement of said second mounting table said cover for opening and closing said upper surface of said image forming unit in an open status; wherein said level setting section sets selectively said image reading unit at either a first level at which said image reading unit is ordinarily used or a second level, higher than said first level, at which a top cover of said image forming unit can be opened; wherein said pushing section is set to have a pushing force to move upward said second mounting table where said releasing section releases said level set at said first level with said level setting section as well as to move downward said second mounting table where said releasing section releases said level set at said second level with said level setting section; and wherein said releasing section has a wire connecting a distant location and said releasing section so that said level set by said level setting section is released by operation of said wire at said distant location.

* * * * *